US008769905B2

(12) United States Patent
Pervan et al.

(10) Patent No.: US 8,769,905 B2
(45) Date of Patent: Jul. 8, 2014

(54) MECHANICAL LOCKING SYSTEM FOR FLOOR PANELS

(75) Inventors: Darko Pervan, Viken (SE); Tony Pervan, Stockholm (SE)

(73) Assignee: Valinge Flooring Technology AB, Viken (SE)

( * ) Notice: Subject to any disclaimer, the term of this patent is extended or adjusted under 35 U.S.C. 154(b) by 0 days.

(21) Appl. No.: 13/585,204

(22) Filed: Aug. 14, 2012

(65) Prior Publication Data

US 2013/0042565 A1 Feb. 21, 2013

Related U.S. Application Data

(60) Provisional application No. 61/523,571, filed on Aug. 15, 2011.

(51) Int. Cl.
*E04B 2/00* (2006.01)
*E04F 15/02* (2006.01)

(52) U.S. Cl.
CPC ... *E04F 15/02038* (2013.01); *E04F 2201/0547* (2013.01); *E04F 2201/0146* (2013.01)
USPC ..... 52/588.1; 52/582.1

(58) Field of Classification Search
CPC ..... E04F 15/02; E04F 15/04; E04F 15/02405; E04F 2201/0138; E04F 2201/0115; E04F 13/08; E04C 2/38; E04B 1/38; B23P 17/04
USPC ..... 52/578, 588.1, 582.1, 582.2, 581, 52/585.1, 586.1, 586.2, 590.1, 590.2, 52/591.1, 591.4, 591.5, 592.1, 592.3, 52/592.4, 396.04, 396.1, 285.1; 403/339, 403/350, 364, 291, 315–316, 319; 292/1, 292/300, DIG. 38, DIG. 53
See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |
| 124,228 | A | 3/1872 | Stuart |
| 213,740 | A | 4/1879 | Conner |
| 274,354 | A | 3/1883 | McCarthy et al. |
| 316,176 | A | 4/1885 | Ransom |
| 634,581 | A | 10/1899 | Miller |
| 861,911 | A | 7/1907 | Stewart |

(Continued)

FOREIGN PATENT DOCUMENTS

| | | | |
|---|---|---|---|
| CA | 2456513 | A1 | 2/2003 |
| CN | 201588375 | U | 9/2010 |

(Continued)

OTHER PUBLICATIONS

U.S. Appl. No. 13/577,042, Pervan.

(Continued)

*Primary Examiner* — William Gilbert
*Assistant Examiner* — Beth Stephan
(74) *Attorney, Agent, or Firm* — Buchanan Ingersoll & Rooney P.C.

(57) ABSTRACT

Building panels, especially floor panels are shown, which are provided with a vertical locking system on adjacent edges including a displaceable tongue that has a main tongue body and separate spring parts attached to the body.

15 Claims, 18 Drawing Sheets

(56) References Cited

U.S. PATENT DOCUMENTS 1,194,636 A 8/1916 Joy
1,723,306 A 8/1929 Sipe
1,743,492 A 1/1930 Sipe
1,809,393 A 6/1931 Rockwell
1,902,716 A 3/1933 Newton
2,026,511 A 12/1935 Storm
2,204,675 A 6/1940 Grunert
2,277,758 A 3/1942 Hawkins
2,430,200 A 11/1947 Wilson
2,497,837 A 2/1950 Nelson
2,596,280 A 5/1952 Nystrom
2,732,706 A 1/1956 Friedman
2,740,167 A 4/1956 Rowley
2,863,185 A 12/1958 Riedi
2,865,058 A 12/1958 Andersson
2,872,712 A 2/1959 Brown et al.
2,889,016 A 6/1959 Warren
3,023,681 A 3/1962 Worson
3,077,703 A 2/1963 Bergstrom
3,099,110 A 7/1963 Spaight
3,147,522 A 9/1964 Schumm
3,271,787 A 9/1966 Clary
3,325,585 A 6/1967 Brenneman
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,720,027 A 3/1973 Christensen
3,722,379 A 3/1973 Koester
3,742,669 A 7/1973 Mansfeld
3,760,547 A 9/1973 Brenneman
3,760,548 A 9/1973 Sauer et al.
3,778,954 A 12/1973 Meserole
3,849,235 A 11/1974 Gwynne
3,919,820 A 11/1975 Green
3,950,915 A 4/1976 Cole
4,007,994 A 2/1977 Brown
4,030,852 A 6/1977 Hein
4,037,377 A 7/1977 Howell et al.
4,064,571 A 12/1977 Phipps
4,080,086 A 3/1978 Watson
4,082,129 A 4/1978 Morelock
4,100,710 A 7/1978 Kowallik
4,107,892 A 8/1978 Bellem
4,113,399 A 9/1978 Hansen, Sr. et al.
4,169,688 A 10/1979 Toshio
4,196,554 A 4/1980 Anderson
4,227,430 A 10/1980 Janssen et al.
4,299,070 A 11/1981 Oltmanns
4,304,083 A 12/1981 Anderson
4,426,820 A 1/1984 Terbrack
4,447,172 A 5/1984 Galbreath
4,512,131 A 4/1985 Laramore
4,599,841 A 7/1986 Haid
4,648,165 A 3/1987 Whitehorne
5,007,222 A 4/1991 Raymond
5,071,282 A 12/1991 Brown
5,148,850 A 9/1992 Urbanick
5,173,012 A 12/1992 Ortwein et al.
5,182,892 A 2/1993 Chase
5,247,773 A 9/1993 Weir
5,272,850 A 12/1993 Mysliwiec et al.
5,344,700 A 9/1994 McGath et al.
5,348,778 A 9/1994 Knipp et al.
5,465,546 A 11/1995 Buse
5,485,702 A 1/1996 Sholton
5,502,939 A 4/1996 Zadok et al.
5,548,937 A 8/1996 Shimonohara
5,598,682 A 2/1997 Haughian
5,618,602 A 4/1997 Nelson
5,634,309 A 6/1997 Polen
5,658,086 A 8/1997 Brokaw et al.
5,671,575 A 9/1997 Wu
5,694,730 A 12/1997 Del Rincon et al.
5,755,068 A 5/1998 Ormiston
5,899,038 A 5/1999 Stroppiana
5,950,389 A 9/1999 Porter
5,970,675 A 10/1999 Schray
6,006,486 A 12/1999 Moriau
6,029,416 A 2/2000 Andersson
6,052,960 A 4/2000 Yonemura
6,065,262 A 5/2000 Motta
6,173,548 B1 1/2001 Hamar et al.
6,182,410 B1 2/2001 Pervan
6,216,409 B1 4/2001 Roy et al.
6,314,701 B1 11/2001 Meyerson
6,345,481 B1 2/2002 Nelson
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,490,836 B1 12/2002 Moriau et al.
6,505,452 B1 1/2003 Hannig et al.
6,553,724 B1 4/2003 Bigler
6,591,568 B1 7/2003 Pålsson
6,601,359 B2 8/2003 Olofsson
6,617,009 B1 9/2003 Chen et al.
6,647,689 B2 11/2003 Pletzer et al.
6,647,690 B1 11/2003 Martensson
6,651,400 B1 11/2003 Murphy
6,670,019 B2 12/2003 Andersson
6,685,391 B1 2/2004 Gideon
6,763,643 B1 7/2004 Martensson
6,766,622 B1 7/2004 Thiers
6,769,219 B2 8/2004 Schwitte et al.
6,769,835 B2 8/2004 Stridsman
6,804,926 B1 10/2004 Eisermann
6,808,777 B2 10/2004 Andersson et al.
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Palsson et al.
7,137,229 B2 11/2006 Pervan
7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 * 11/2008 Hannig ..... 52/586.1
7,454,875 B2 11/2008 Pervan et al.
7,516,588 B2 4/2009 Pervan
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan et al.
7,637,068 B2 12/2009 Pervan
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.

(56) References Cited

U.S. PATENT DOCUMENTS 7,856,789 B2 12/2010 Eisermann
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,039 B2 7/2011 Groeke
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,234,830 B2 * 8/2012 Pervan et al. ..... 52/588.1
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
2001/0024707 A1 9/2001 Andersson et al.
2002/0031646 A1 3/2002 Chen et al.
2002/0046433 A1 4/2002 Sellman, Jr. et al.
2002/0069611 A1 6/2002 Leopolder
2002/0092263 A1 7/2002 Schulte
2002/0100231 A1 8/2002 Miller et al.
2002/0170258 A1 11/2002 Schwitte et al.
2002/0170259 A1 11/2002 Ferris
2002/0178674 A1 12/2002 Pervan
2002/0178680 A1 12/2002 Martensson
2003/0009971 A1 1/2003 Palmberg
2003/0024199 A1 2/2003 Pervan et al.
2003/0037504 A1 2/2003 Schwitte et al.
2003/0084636 A1 5/2003 Pervan
2003/0094230 A1 5/2003 Sjoberg
2003/0101681 A1 6/2003 Tychsen
2003/0154676 A1 8/2003 Schwartz
2003/0180091 A1 9/2003 Stridsman
2003/0188504 A1 10/2003 Ralf
2003/0196405 A1 10/2003 Pervan
2004/0031227 A1 2/2004 Knauseder
2004/0049999 A1 3/2004 Krieger
2004/0060255 A1 4/2004 Knauseder
2004/0068954 A1 * 4/2004 Martensson ..... 52/592.1
2004/0107659 A1 6/2004 Glockl
2004/0123548 A1 7/2004 Gimpel et al.
2004/0128934 A1 7/2004 Hecht
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hannig
2004/0250492 A1 12/2004 Becker
2004/0255541 A1 12/2004 Thiers
2004/0261348 A1 12/2004 Vulin
2005/0003132 A1 1/2005 Blix et al.
2005/0028474 A1 2/2005 Kim
2005/0050827 A1 3/2005 Schitter
2005/0138881 A1 6/2005 Pervan
2005/0160694 A1 7/2005 Pervan
2005/0166514 A1 8/2005 Pervan
2005/0205161 A1 9/2005 Lewark
2005/0210810 A1 9/2005 Pervan
2005/0235593 A1 10/2005 Hecht
2006/0053724 A1 3/2006 Braun et al.
2006/0070333 A1 4/2006 Pervan
2006/0099386 A1 5/2006 Smith
2006/0101769 A1 5/2006 Pervan et al.
2006/0156670 A1 7/2006 Knauseder
2006/0236642 A1 10/2006 Pervan
2006/0260254 A1 11/2006 Pervan
2007/0006543 A1 1/2007 Engstrom
2007/0011981 A1 1/2007 Eisermann
2007/0028547 A1 2/2007 Grafenauer
2007/0065293 A1 3/2007 Hannig
2007/0108679 A1 5/2007 Grothaus
2007/0151189 A1 7/2007 Yang
2007/0175143 A1 8/2007 Pervan et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000185 A1 1/2008 Duernberger
2008/0005989 A1 1/2008 Pervan et al.
2008/0010931 A1 * 1/2008 Pervan et al. ..... 52/403.1
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 * 5/2008 Pervan et al. ..... 52/588.1
2008/0110125 A1 * 5/2008 Pervan ..... 52/582.2
2008/0134607 A1 6/2008 Pervan et al.
2008/0134613 A1 * 6/2008 Pervan ..... 52/582.2
2008/0155930 A1 7/2008 Pervan et al.
2008/0172971 A1 7/2008 Pervan
2008/0216434 A1 9/2008 Pervan
2008/0216920 A1 9/2008 Pervan
2008/0236088 A1 10/2008 Hannig
2008/0263975 A1 10/2008 Mead
2008/0295432 A1 12/2008 Pervan et al.
2009/0019806 A1 1/2009 Muehlebach
2009/0100782 A1 4/2009 Groeke et al.
2009/0133353 A1 5/2009 Pervan et al.
2009/0151290 A1 6/2009 Liu
2009/0155612 A1 6/2009 Pervan et al.
2009/0193741 A1 8/2009 Cappelle
2009/0193748 A1 8/2009 Boo et al.
2009/0193753 A1 8/2009 Schitter
2009/0308014 A1 12/2009 Muehlebach
2010/0043333 A1 2/2010 Hannig
2010/0083603 A1 4/2010 Goodwin
2010/0173122 A1 7/2010 Susnjara
2010/0281803 A1 * 11/2010 Cappelle ..... 52/309.1
2010/0293879 A1 11/2010 Pervan et al.
2010/0300029 A1 12/2010 Braun et al.
2010/0300030 A1 12/2010 Pervan et al.
2010/0300031 A1 * 12/2010 Pervan et al. ..... 52/588.1
2010/0319291 A1 12/2010 Pervan et al.
2011/0016815 A1 1/2011 Yang
2011/0030303 A1 2/2011 Pervan et al.
2011/0041996 A1 2/2011 Pervan
2011/0088344 A1 * 4/2011 Pervan et al. ..... 52/588.1
2011/0088345 A1 4/2011 Pervan
2011/0131916 A1 6/2011 Chen
2011/0154763 A1 6/2011 Bergelin et al.
2011/0167750 A1 7/2011 Pervan
2011/0167751 A1 7/2011 Engstrom
2011/0197535 A1 8/2011 Baker et al.
2011/0225922 A1 9/2011 Pervan et al.
2011/0252733 A1 10/2011 Pervan et al.
2011/0271632 A1 11/2011 Cappelle et al.
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0096801 A1 4/2012 Cappelle
2012/0124932 A1 5/2012 Schulte et al.
2012/0151865 A1 6/2012 Pervan et al.
2012/0174515 A1 7/2012 Pervan et al.
2012/0174520 A1 7/2012 Pervan
2012/0174521 A1 7/2012 Schulte et al.
2012/0192521 A1 8/2012 Schulte
2012/0279161 A1 11/2012 Håkansson et al.

(56) References Cited

U.S. PATENT DOCUMENTS

| | | | | |
|---|---|---|---|---|
| 2013/0008117 | A1 | 1/2013 | Pervan | |
| 2013/0014463 | A1 | 1/2013 | Pervan | |
| 2013/0019555 | A1 | 1/2013 | Pervan | |
| 2013/0036695 | A1 | 2/2013 | Durnberger | |
| 2013/0042562 | A1 | 2/2013 | Pervan | |
| 2013/0042563 | A1 | 2/2013 | Pervan | |
| 2013/0042564 | A1* | 2/2013 | Pervan et al. | 52/588.1 |
| 2013/0047536 | A1 | 2/2013 | Pervan | |
| 2013/0055950 | A1 | 3/2013 | Pervan et al. | |
| 2013/0081349 | A1 | 4/2013 | Pervan et al. | |
| 2013/0111845 | A1 | 5/2013 | Pervan | |
| 2013/0145708 | A1 | 6/2013 | Pervan | |
| 2013/0160390 | A1 | 6/2013 | Stockl | |
| 2013/0160391 | A1 | 6/2013 | Pervan et al. | |
| 2013/0232905 | A2 | 9/2013 | Pervan | |

FOREIGN PATENT DOCUMENTS

| | | | |
|---|---|---|---|
| DE | 39 32 980 | A1 | 11/1991 |
| DE | 299 22 649 | U1 | 4/2000 |
| DE | 200 01 788 | U1 | 6/2000 |
| DE | 199 40 837 | A1 | 11/2000 |
| DE | 199 58 225 | A1 | 6/2001 |
| DE | 202 06 460 | U1 | 7/2002 |
| DE | 202 05 774 | U1 | 8/2002 |
| DE | 10 2004 001 363 | A1 | 8/2004 |
| DE | 202 20 799 | U1 | 4/2005 |
| DE | 10 2004 055 951 | A1 | 7/2005 |
| DE | 10 2004 054 368 | A1 | 5/2006 |
| DE | 10 2005 024 366 | A1 | 11/2006 |
| DE | 10 2006 024 184 | A1 | 11/2007 |
| DE | 10 2006 037 614 | B3 | 12/2007 |
| DE | 10 2006 057 491 | A | 6/2008 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 048 050 | B3 | 1/2011 |
| EP | 0 013 852 | A1 | 8/1980 |
| EP | 0 871 156 | A2 | 10/1998 |
| EP | 0 974 713 | A1 | 1/2000 |
| EP | 1 308 577 | A2 | 5/2003 |
| EP | 1 350 904 | A2 | 10/2003 |
| EP | 1 350 904 | A3 | 10/2003 |
| EP | 1 357 239 | A2 | 10/2003 |
| EP | 1 357 239 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 017 403 | A2 | 1/2009 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-288017 | A | 10/1994 |
| JP | 6-306961 | A | 11/1994 |
| JP | 6-322848 | A | 11/1994 |
| JP | 7-300979 | A | 11/1995 |
| JP | 8-086080 | A | 4/1996 |
| WO | WO 94/26999 | A1 | 11/1994 |
| WO | WO 97/47834 | A1 | 12/1997 |
| WO | WO 98/22677 | A1 | 5/1998 |
| WO | WO 00/20705 | A1 | 4/2000 |
| WO | WO 00/43281 | A1 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/98604 | A1 | 12/2001 |
| WO | WO 02/48127 | | 6/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/078761 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/053257 | A1 | 6/2004 |
| WO | WO 2004/053257 | A8 | 6/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2007/015669 | A2 | 2/2007 |
| WO | WO 2007/079845 | A1 | 7/2007 |
| WO | WO 2007/089186 | A1 | 8/2007 |
| WO | WO 2007/118352 | A1 | 10/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A | 6/2008 |
| WO | WO 2009/116926 | A1 | 9/2009 |
| WO | WO 210/006684 | A2 | 1/2010 |
| WO | WO 2010/070472 | A2 | 6/2010 |
| WO | WO 2010/070605 | A2 | 6/2010 |
| WO | WO 2010/087752 | A1 | 8/2010 |
| WO | WO 2010/108980 | A1 | 9/2010 |
| WO | WO 2010/13617 | A1 | 12/2010 |
| WO | WO 2011/001326 | A2 | 1/2011 |
| WO | WO 2011/012104 | A2 | 2/2011 |
| WO | WO 2011/032540 | A2 | 3/2011 |
| WO | WO 2011/127981 | A1 | 10/2011 |
| WO | WO 2011/151758 | A2 | 12/2011 |

OTHER PUBLICATIONS

U.S. Appl. No. 13/540,107, Pervan.
U.S. Appl. No. 13/544,281, Pervan.
U.S. Appl. No. 13/546,569, Pervan.
U.S. Appl. No. 13/585,485, Pervan.
U.S. Appl. No. 13/585,179, Pervan.
U.S. Appl. No. 13/569,988, Pervan.
U.S. Appl. No. 13/660,538, Pervan et al.
U.S. Appl. No. 13/670,039, Pervan et al.
U.S. Appl. No. 13/728,121, Pervan et al.
U.S. Appl. No. 61/620,233, Boo.
U.S. Appl. No. 61/620,246, Boo.
Pervan, Darko, et al., U.S. Appl. No. 13/577,042, entitled "Mechanical Locking System for Floor Panels," filed in the U.S. Patent and Trademark Office on Aug. 3, 2012.

(56) References Cited

OTHER PUBLICATIONS

Pervan, Darko, U.S. Appl. No. 13/540,107, entitled "Mechanical Locking of Floor Panels with a Glued Tongue," filed in the U.S. Patent and Trademark Office on Jul. 2, 2012.
Pervan, Darko, U.S. Appl. No. 13/544,281, entitled "Mechanical Locking System for Floor Panels," filed in the U.S. Patent and Trademark Office on Jul. 9, 2012.
Pervan, Darko, et al., U.S. Appl. No. 13/546,569, entitled "Mechanical Locking System for Floor Panels," filed in the U.S. Patent and Trademark Office on Jul. 11, 2012.
Pervan, Darko, et al., U.S. Appl. No. 13/585,485, entitled "Mechanical Locking System for Floor Panels," filed in the U.S. Patent and Trademark Office on Aug. 14, 2012.
Pervan, Darko, et al., U.S. Appl. No. 13/585,179, entitled, "Mechanical Locking System for Floor Panels," filed in the U.S. Patent and Trademark Office on Aug. 14, 2012.
Pervan, Darko, et al., U.S. Appl. No. 13/596,988, entitled, "Mechanical Locking System for Floor Panels," filed in the U.S. Patent and Trademark Office on Aug. 28, 2012.
Pervan, Darko, et al., U.S. Appl. No. 13/660,538, entitled "Mechanical Locking of Floor Panels with Vertical Snap Folding," filed in the U.S. Patent and Trademark Office on Oct. 25, 2012.
Pervan, Darko, et al., U.S. Appl. No. 13/670,039, entitled "Mechanical Locking of Floor Panels with a Flexible Tongue," filed in the U.S. Patent and Trademark Office on Nov. 6, 2012.
Pervan, Darko, et al., U.S. Appl. No. 13/728,121, entitled "Mechanical Locking of Floor Panels with a Flexible Tongue," filed in the U.S. Patent and Trademark Office on Dec. 27, 2012.
Boo, Christian, U.S. Appl. No. 61/620,233, entitled "Building Panel with a Mechanical Locking System," filed in the U.S. Patent and Trademark Office on Apr. 4, 2012.
Boo, Christian, U.S. Appl. No. 61/620,246, entitled "Method for Producing a Mechanical Locking System for Building Panels," filed in the U.S. Patent and Trademark Office on Apr. 4, 2012.
Välinge Innovation AB, Technical Disclosure entitled "Mechanical locking for floor panels with a flexible bristle tongue," IP.com number: IPCOM000145262D, Jan. 12, 2007, IP.com PriorArtDatabase, 57 pages.
Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.
Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.
Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.
Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.
Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.
Pervan, Darko (Author)/Välinge Flooring Technology, Technical Disclosure entitled "VA066b Glued Tongue," IP com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP com No. IPCOM000208542D, Jul. 12, 2011, IP.com Prior Art Database, 37 pages.
Pervan, Darko (Author)/Välinge Flooring Technology, Technical Disclosure entitled "VA068 Press Lock VFT," IP com No. IPCOM000208854D, Jul. 20, 2011, IP.com Prior Art Database, 25 pages.
Pervan, Darko (Author), Technical Disclosure entitled "VA069 Combi Tongue," IP com No. IPCOM000210866D, Sep. 13, 2011, IP.com Prior Art Database, 41 pages.
Pervan, Darko(Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
Pervan, Darko, et al., U.S. Appl. No. 13/758,603, entitled "Mechanical Locking System for Panels and Method of Installing Same," filed in the U.S. Patent and Trademark Office Feb. 4, 2013.
U.S. Appl. No. 13/855,966, Boo.
U.S. Appl. No. 13/855,979, Boo et al.
Boo, Christian, U.S. Appl. No. 13/855,966, entitled "Building Panel with a Mechanical Locking System," filed in the U.S. Patent and Trademark Office on Apr. 3, 2013.
Boo, Christian, et al., U.S. Appl. No. 13/855,979, entitled "Method for Producing a Mechanical Locking System for Building Panels," filed in the U.S. Patent and Trademark Office on Apr. 3, 2013.
International Search Report mailed Dec. 13, 2012 in PCT/SE2012/050871, Swedish Patent Office, Stockholm, Sweden, 8 pages.
U.S. Appl. No. 13/886,916, Pervan et al.
Pervan, Darko, et al., U.S. Appl. No. 13/886,916, entitled "Mechanical Locking of Building Panels," filed in the U.S. Patent and Trademark Office on May 3, 2013.
Pervan, Darko, U.S. Appl. No. 14/042,887 entitled "Mechanical Locking of Floor Panels with a Glued Tongue," filed in the U.S. Patent and Trademark Office on Oct. 1, 2013.
Pervan, Darko, et al., U.S. Appl. No. 14/046,235 entitled "Mechanical Locking of Floor Panels with a Flexible Tongue," filed in the U.S. Patent and Trademark Office on Oct. 4, 2013.
Nygren, Per, et al., U.S. Appl. No. 61/774,749, entitled "Building panels provided with a Mechanical Locking System," filed in the U.S. Patent and Trademark Office on Mar. 8, 2013.
Pervan, Darko, et al., U.S. Appl. No. 13/962,446, entitled "Mechanical Locking System for Floor Panels," filed in the U.S. Patent and Trademark Office on Aug. 8, 2013.
Pervan, Darko, U.S. Appl. No. 14/011,042 entitled "Mechanical Locking System for Floor Panels," filed in the U.S. Patent and Trademark Office on Aug. 27, 2013.
Pervan, Darko, et al., U.S. Appl. No. 14/011,121 entitled "Mechanical Locking System for Floor Panels with Vertical Snap Folding," filed in the U.S. Patent and Trademark Office on Aug. 27, 2013.
Pervan, Darko, U.S. Appl. No. 14/080,105 entitled "Mechanical Locking of Floor Panels with Vertical Folding," filed in the U.S. Patent and Trademark Office on Nov. 14, 2013.
Pervan, Darko, et al., U.S. Appl. No. 14/095,052, entitled "Mechanical Locking of Floor Panels," filed in the U.S. Patent and Trademark Office on Dec. 3, 2013.
Pervan, Darko, et al., U.S. Appl. No. 14/138,330 entitled "Mechanical Locking System for Floor Panels," filed in the U.S. Patent and Trademark Office on Dec. 23, 2013.
Pervan, Darko, U.S. Appl. No. 14/138,385 entitled "Mechanical Locking System for Panels and Method of Installing Same," filed in the U.S. Patent and Trademark Office on Dec. 23, 2013.
Pervan, Darko, et al., U.S. Appl. No. 14/152,402 entitled "Mechanical Locking System for Floor Panels," filed in the U.S. Patent and Trademark Office on Jan. 10, 2014.
Pervan, Darko, et al., U.S. Appl. No. 14/206,286, entitled "Mechanical Locking System for Panels and Method of Installing Same," filed in the U.S. Patent and Trademark Office on Mar. 12, 2014.
Pervan, Darko, U.S. Appl. No. 14/270,711, entitled "Mechanical Locking System for Floor Panels," filed May 6, 2014.

* cited by examiner

Known Art

Known Art

MECHANICAL LOCKING SYSTEM FOR FLOOR PANELS

This application claims the benefit of U.S. Provisional Application No. 61/523,571 filed on Aug. 15, 2011. The disclosure of the prior application is hereby incorporated by reference herein in its entirety.

TECHNICAL FIELD

The disclosure generally relates to the field of mechanical locking systems for floor panels and building panels. The disclosure shows floorboards, locking systems, installation methods and production methods.

FIELD OF APPLICATION

Embodiments of the present disclosure are particularly suitable for use in floating floors, which are formed of floor panels which are joined mechanically with a locking system integrated with the floor panel, i.e. mounted at the factory, are made up of one or more upper layers of wood or wood veneer, decorative laminate, powder based surfaces or decorative plastic material, an intermediate core of wood-fibre-based material or plastic material and preferably a lower balancing layer on the rear side of the core. Floor panels with a surface layer of cork, linoleum, rubber or soft wear layers, for instance needle felt glued to a board, printed and preferably also varnished surface and floors with hard surfaces such as stone, tile and similar materials are included. Embodiments of the disclosure may also be used for joining building panels which preferably contain a board material for instance wall panels, ceilings, furniture components and similar.

The following description of known technique, problems of known systems and objects and features of the disclosure will therefore, as a non-restrictive example, be aimed above all at this field of application and in particular at panels formed as rectangular floor panels with long and shorts edges intended to be mechanically joined to each other on both long and short edges.

The long and short edges are mainly used to simplify the description of embodiments of the disclosure. The panels may be square. Embodiments of the disclosure are preferably used on the short edges. It should be emphasised that embodiments of the disclosure may be used in any floor panel and it may be combined with all types of known locking system formed on the long edges, where the floor panels are intended to be joined using a mechanical locking system connecting the panels in the horizontal and vertical directions on at least two adjacent sides.

BACKGROUND

Laminate flooring usually comprises a core of a 6-12 mm fibre board, a 0.2-0.8 mm thick upper decorative surface layer of laminate and a 0.1-0.6 mm thick lower balancing layer of laminate, plastic, paper or like material. A laminate surface comprises of melamine-impregnated paper. The most common core material is fibreboard with high density and good stability usually called HDF—High Density Fibreboard. Sometimes also MDF—Medium Density Fibreboard—is used as core.

Traditional laminate floor panels of this type have been joined by means of glued tongue-and-groove joints.

In addition to such traditional floors, floor panels have been developed which do not require the use of glue and instead are joined mechanically by means of so-called mechanical locking systems. These systems comprise locking means, which lock the panels horizontally and vertically. The mechanical locking systems are usually formed by machining of the core of the panel. Alternatively, parts of the locking system may be formed of a separate material, for instance aluminum or HDF, which is integrated with the floor panel, i.e. joined with the floor panel in connection with the manufacture thereof.

The main advantages of floating floors with mechanical locking systems are that they are easy to install. They may also easily be taken up again and used once more at a different location.

DEFINITION OF SOME TERMS

In the following text, the visible surface of the installed floor panel is called "front side", while the opposite side of the floor panel, facing the sub floor, is called "rear side". The edge between the front and rear side is called "joint edge". By "horizontal plane" is meant a plane, which extends parallel to the outer part of the surface layer. Immediately juxtaposed upper parts of two adjacent joint edges of two joined floor panels together define a "vertical plane" perpendicular to the horizontal plane. By "inner vertical tongue plane" is meant a plane, which is parallel with a vertical plane that intersects the outer and most inner part of the main tongue body. By "vertical locking" is meant locking parallel to the vertical plane. By "horizontal locking" is meant locking parallel to the horizontal plane.

By "up" is meant towards the front side, by "down" towards the rear side, by "inwardly" mainly horizontally towards an inner and centre part of the panel and by "outwardly" mainly horizontally away from the centre part of the panel.

By "locking systems" are meant co acting connecting elements, which connect the floor panels vertically and/or horizontally.

RELATED ART AND PROBLEMS THEREOF

For mechanical joining of long edges as well as short edges in the vertical and in the first horizontal direction perpendicular to the edges several methods may be used. One of the most used methods is the angle-snap method. The long edges are installed by angling. The panel is than displaced in locked position along the long side. The short edges are locked by horizontal snapping. The vertical connection is generally a tongue and a groove. During the horizontal displacement, a strip with a locking element is bent and when the edges are in contact, the strip springs back and a locking element enters a locking groove and locks the panels horizontally. Such a snap connection is complicated since a hammer and a tapping block usually needs to be used to overcome the friction between the long edges and to bend the strip during the snapping action.

Similar locking systems may also be produced with a rigid strip and they are connected with an angling-angling method where both short and long edges are angled into a locked position.

Recently new and very efficient locking systems have been introduced with a separate flexible or displaceable integrated tongue on the short edge that allows installation with only an angling action, generally referred to as "vertical folding". Such a system is described in WO 03/083234 and WO 2006/043893 (Välinge Innovation AB).

Several versions are used on the market. FIG. 1*a*-1*c* show a locking system comprising a displaceable tongue 30 that is displaced inwardly into a displacement groove 21 and outwardly into a tongue groove 20 when the edges of adjacent panels 1,1' are displaced vertically against each other. Such systems are referred to as vertical snap systems and they provide an automatically locking during the folding action. The displaceable tongue 30 locks the panels vertically parallel to a vertical plane VP perpendicular to a main horizontal plane of the panels. A locking strip 6 with a locking element 8 that cooperates with a locking groove 14 in the adjacent panel 1' locks the edges horizontally parallel to a main horizontal plane HP.

FIGS. 2*a*-2*e* show one of the most used flexible tongues the so-called bristle tongue, which is formed in one piece. Such a displaceable tongue 30 comprises a main tongue body 31 that is strong and rather rigid, flexible protrusions 38 that provides the necessary flexibility and friction connections 36 that prevents the tongue to fall out from the displacement groove 21 during transport and installation of the floor panels. Bristle tongues are made of high quality plastic material reinforced with glass fibres. The flexibility must be considerable and allow that a flexible tongue is displaced in two directions about 1-2 mm during locking. The tongues are injection moulded and formed into tongue blanks 50 that may comprise up to 32 tongues. The tongues are connected to rails 51 which are used to feed the tongues during production when they are separated from the tongue blank and inserted into an edge of a panel.

Although such locking systems and one-piece bristle tongues are very efficient and provide a strong and reliable locking, there is still a room for improvements.

One disadvantage is that the whole tongue blank 50 is made of a high quality plastic material that is rather costly. Such high quality material is only needed in those parts of the tongue that form the flexible protrusions 36. High quality plastic material reinforced with glass fibres is not required in the parts of the tongue that comprises the main tongue body 31 and the rails 51. About 60% of a tongue blank is made of a material that is of a higher quality than required for its specific function.

A second disadvantage is that each tongue blank 50 must be individually designed for a specific width of a floor panel and this requires a wide range of expensive injection moulding tongues for each width.

A third disadvantage is that glass fibre reinforced plastic material is difficult to recycle and the scrap from the rails has a very low material value.

It would be a major advantage if the tongues could be made in a more cost efficient way regarding material costs and different tongue lengths.

It is known from the above-mentioned publications that a displaceable tongue may be formed from a sheet shaped materials such as HDF. This may decrease the material costs with about 80% compared to high cost plastic materials. The flexibility may be obtained by a flexible rubber strip that is inserted into an inner part of a displacement groove or attached to an inner part of an extruded plastic section. Such a two-piece tongue will not provide sufficient strength and flexibility since the compression takes place outside the displaceable tongue between the inner part of a displacement groove and the inner edge of the tongue body. The groove must be rather deep and this will have a negative effect on the joint stability. It is not shown how the flexible material should be attached to tongues in a tongue blank and how friction connections should be formed that allow the tongue to slide in the groove without the risk that the tongue will fall out from the groove after production. The cost of the flexible material is still rather high since the flexible part extends along the whole tongue length.

SUMMARY AND OBJECTS

An overall objective of embodiments of the present disclosure is to provide an improved and more cost efficient locking system for primarily rectangular floor panels with long and short edges installed in parallel rows, which allows that the short edges may be locked to each other automatically with a vertical snap action caused by a tongue that is displaced in a groove. More specifically the objective is to provide a locking system with a separate displaceable tongue that is formed of different materials such that the cost and function may be optimised.

Another specific objective is to provide a tongue that may be produced in different lengths without the need of individual injection moulding tools specially designed for each tongue length.

The above objects of embodiments of the disclosure may be achieved wholly or partly by locking systems and floor panels according to the disclosure. Embodiments of the disclosure are evident from the description and drawings.

A first aspect of the disclosure is building panels provided with a locking system for vertical locking of a first and a second building panel by a vertical displacement of the panel relative each other. A displaceable tongue is attached into a sidewardly open displacement groove provided at an edge of the first panel. Said tongue cooperates with a tongue groove provided at an adjacent edge of the second panel for locking the edges vertically. A strip protrudes below the displacement groove and outwardly beyond the upper part of the edge or below the tongue groove and outwardly beyond the upper part of the adjacent edge. The displaceable tongue comprises a main tongue body extending along the edge of the first panel and a separate flexible spring part attached to the main tongue body. The separate spring part is located in an inner part of the displacement groove.

The tongue may comprise two or more spring parts that are spaced from each other in the length direction of the main tongue body.

The spring parts may be asymmetric in a direction along the edge.

The main tongue body and the spring parts may be made of different materials.

The tongue may comprise an upwardly or downwardly open fixing groove.

The spring parts may comprise an upwardly or downwardly extending fixing connection part.

The spring part may during locking be displaced or compressed horizontally beyond a vertical tongue plane that comprises an inner part of the tongue body.

The spring part may overlap a part or the tongue body during locking.

The spring part may be located in a vertically open flexing cavity formed in the tongue body.

The building panels are preferably floor panels.

A second aspect of the disclosure is a tongue blank comprising at least two tongues which are each designed to be inserted into a groove of a building panel and lock the building panel to an adjacent building panel. A part of the tongue is configured to be displaced during locking. The tongues are of an elongated shape and each tongue comprises a separate spring part connected to a main body of the tongue.

The separate spring part may be asymmetric in the length direction of the tongue.

Each tongue may comprise two or more spring parts that are spaced from each other in the length direction of the tongue.

BRIEF DESCRIPTION OF THE DRAWINGS

The disclosure will in the following be described in connection to exemplary embodiments and in greater detail with reference to the appended exemplary drawings, wherein.

DETAILED DESCRIPTION OF EMBODIMENTS

To facilitate understanding, several locking systems in the figures are shown schematically. It should be emphasised that improved or different functions may be achieved using combinations of the embodiments.

All embodiments may be used separately or in combinations. Angles, dimensions, rounded parts, spaces between surfaces etc. are only examples and may be adjusted within the basic principles of the disclosure.

FIGS. 3*a*-3*g* show a first preferred embodiment of a displaceable tongue 30 which is intended to be used to lock two adjacent edges of two floor panels by a vertical displacement of the panels relative each other.

Figure 1A:
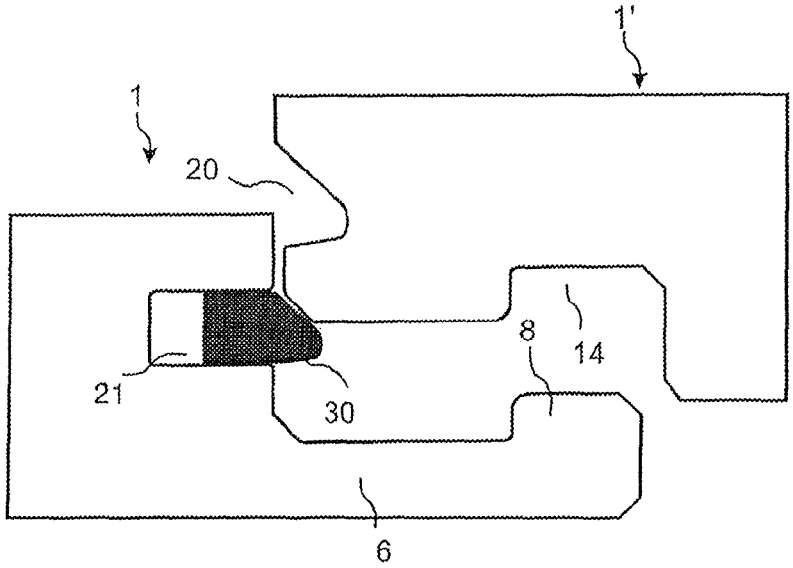
FIGS. 1*a-c* illustrate locking systems according to known technology.
Figure 1B:
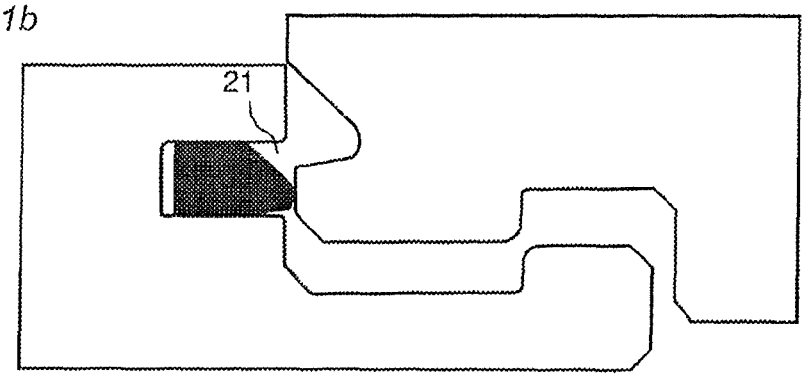
Figure 1C:
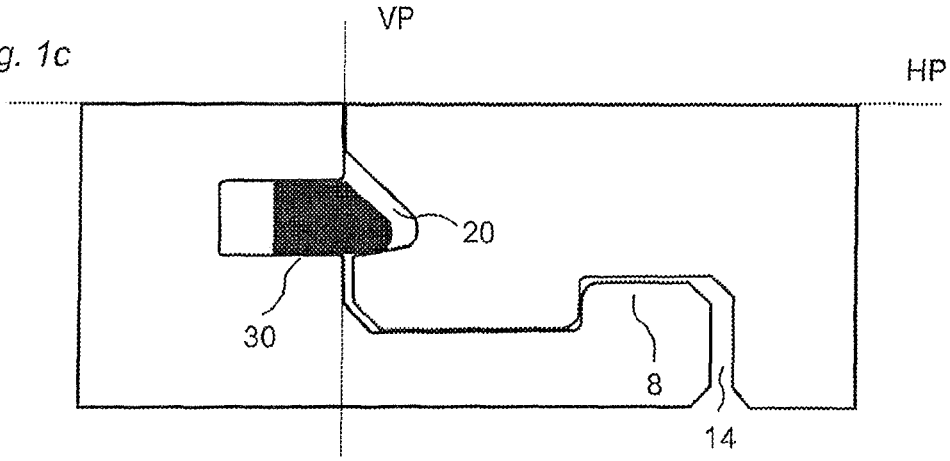
Figure 2A:
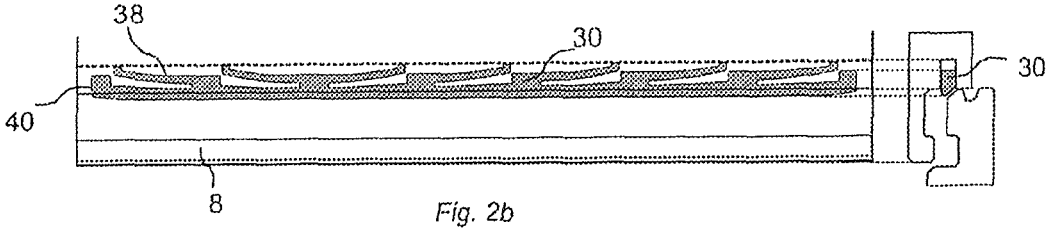
FIGS. 2*a-e* illustrate a flexible and displaceable tongue according to known technology.
Figure 2B:
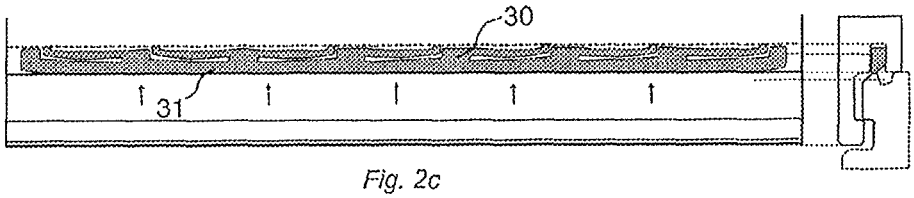
Figure 2C:
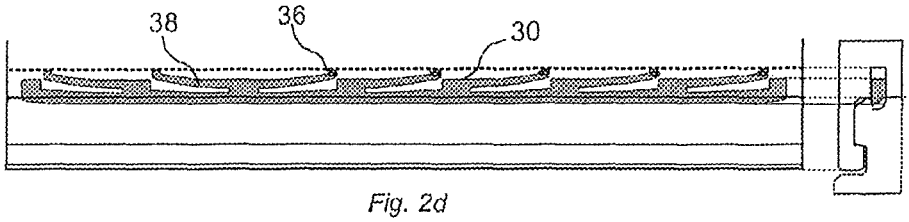
Figure 2D:
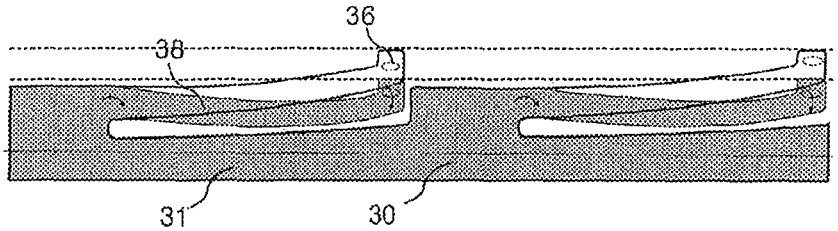
Figure 2E:
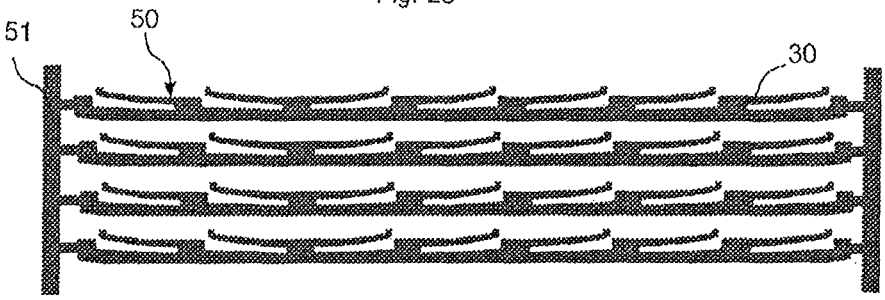
Figure 3A:
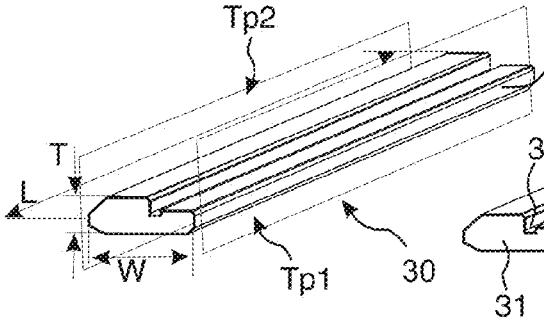
FIGS. 3*a*-3*g* illustrate a displaceable tongue according to an embodiment of the disclosure.

FIG. 3*a* show a displaceable tongue 30 with a main tongue body 31, a length direction L along the joint, a width W perpendicular to the length and parallel to a horizontal plane and a thickness perpendicular to the width. An inner vertical tongue plane Tp1 and an outer vertical tongue plane Tp2 parallel with the length direction of the tongue intersects the outer edges of the tongue.

Figure 3B:
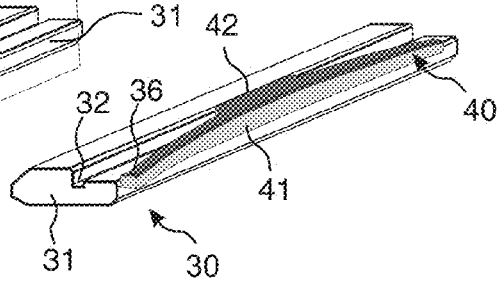

FIG. 3*b* shows a displaceable tongue 30 comprising a separate spring part 40 attached to the main tongue body 31. The spring part comprises a spring part body 41, a friction connection 36, preferably formed as a small local protrusion extending vertically from the spring part body 41 and a fixing connection part 42 that is fixed into a fixing groove 32 formed in the main tongue body 31.

Figure 3C:
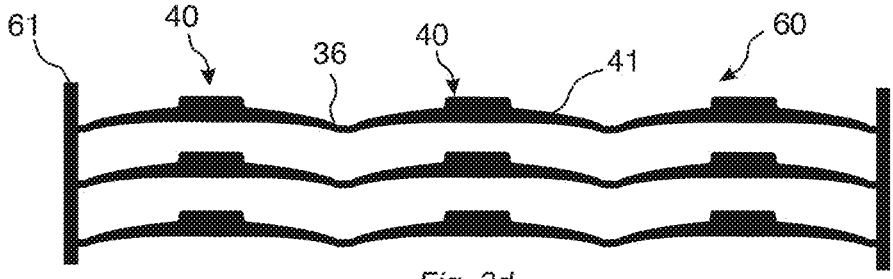

FIG. 3*c* shows a spring part blank 60 seen from above comprising several spring parts 40 connected to each other in parallel rows and to spring part rails 61.

Figure 3D:
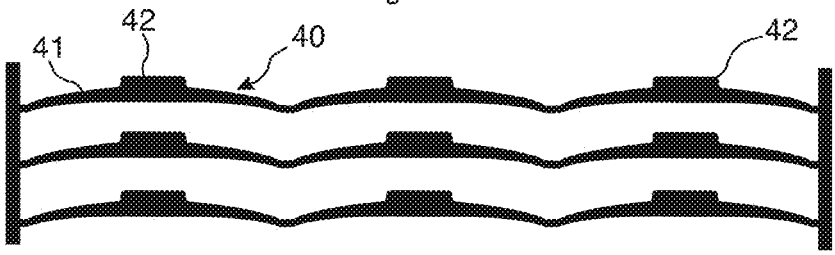

FIG. 3*d* shows the spring part blank seen from below. Each spring part 40 comprises a fixing connection part 42 that in this embodiment is formed as a protrusion extending vertically from the main spring part body 41 and in opposite direction to the extension of the friction connection 36.

Figure 3E:
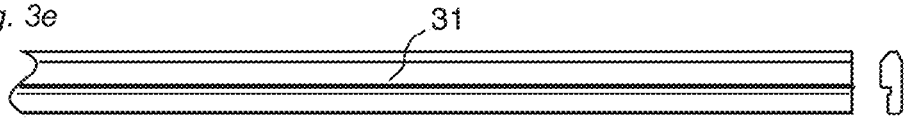

FIG. 3*e* shows a main tongue body 31 that in this embodiment is formed as a two dimensional profile with the same cross section along the tongue body. Such a tongue body may be formed by, for example, linear machining, extrusion or by injection moulding where rather simple moulding tools are used.

Figure 3F:
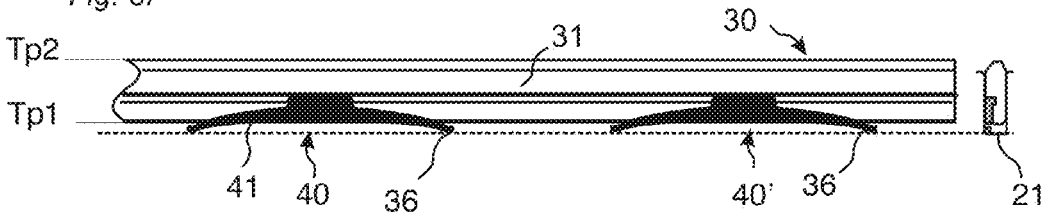

FIG. 3*f* shows a displaceable tongue in an outer locked position, which tongue comprises a main tongue body 31 and two separate spring parts 40,40' mechanically connected to the tongue body 31 and spaced from each other in the length direction of the tongue 30.

Figure 3G:
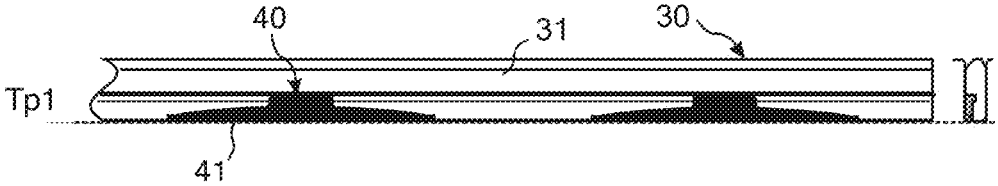

FIG. 3*g* shows the displaceable tongue in an inner unlocked position when the tongue 30 is pressed into a sidewardly open displacement groove 21. The spring part is displaced inwardly beyond the first vertical tongue plane Tp1 but also above a part of the main tongue body 31. The thickness of the spring part is smaller than the thickness of the tongue body 31. This embodiment offers the advantage that the spring part may be easily connected to a tongue body that has a rather simple cross section and that the depth of the displacement groove may be reduced since the main tongue body 31 and the spring part body 41 may overlap each other in locked and unlocked position.

Any type of polymer materials may be used to form spring parts such as PA (nylon), POM, PC, PP, PET or PE or similar having the properties described above in the different embodiments. These plastic materials may be, when injection moulding is used, reinforced with for instance glass fibre, Kevlar fibre, carbon fibre or talk or chalk. A preferred material is glass fibre, preferably extra long, reinforced PP or POM. Such materials may also be used to form the main tongue body.

The tongue body preferably comprises a low cost material that preferably may be machined. Suitable materials are wood fibre based materials combined with thermoplastic or thermosetting binders.

Figure 4A:
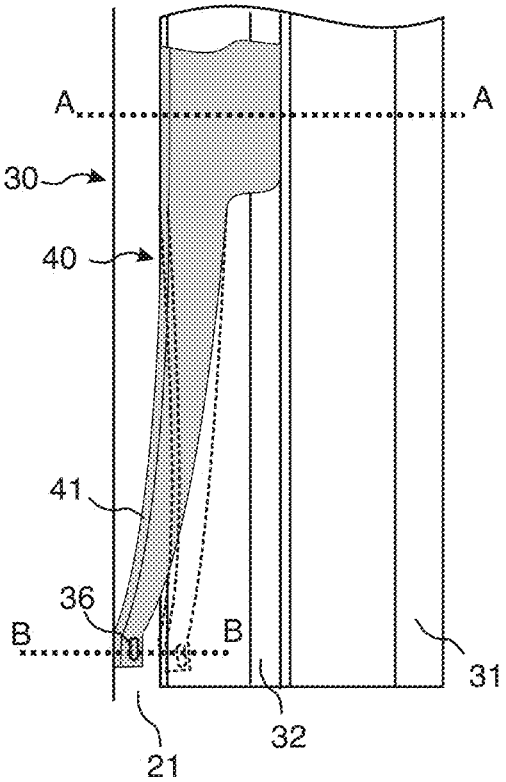
FIGS. 4*a-d* illustrate the function of a spring part according to an embodiment of the disclosure.
Figure 4B:
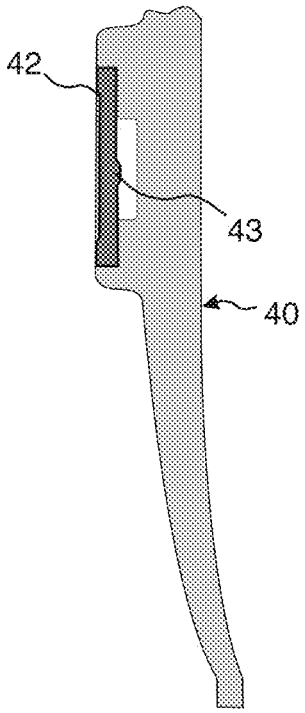

FIG. 4*a* shows a part of a displaceable tongue 30 comprising a spring part 40 connected to an upper part of a main tongue body 31. FIG. 4*b* shows the spring part 40 from below with a fixing connection part 42 that is flexible and adapted to be connected vertically into a vertically open fixing groove 32 formed on the upper part of the tongue body 31. The fixing connection part 42 comprises a horizontal friction protrusion 43 that presses against a vertical wall of the fixing groove 32.

Figure 4C:
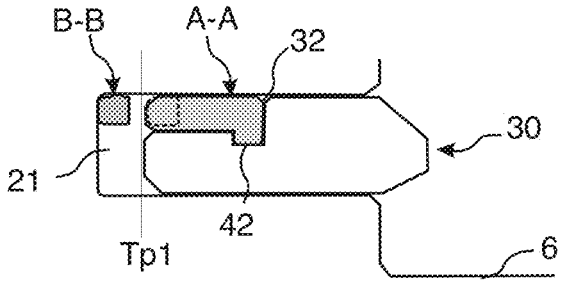
Figure 4D:
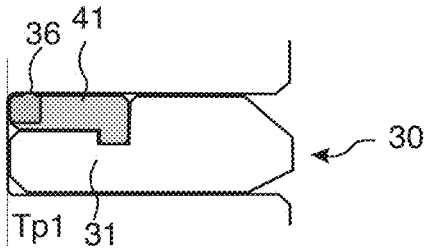

FIG. 4*c* shows the flexible tongue 30 in outer position and FIG. 4*d* shows the flexible tongue 30 in an inner position. A-A shows the cross section of a middle part of the main tongue body. B-B shows the cross section of an outer part of the main tongue body. The figures show that a part of the spring part body 41 is located above an upper part of the tongue body 31 and displaced beyond the first vertical tongue plane Tp1 during locking such that it overlaps the main tongue body.

Figure 5A:
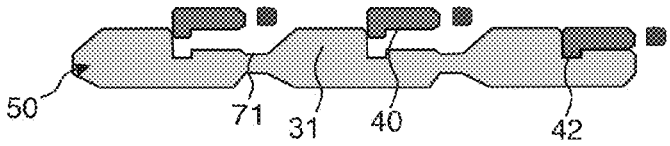
FIGS. 5*a-g* illustrate forming and separation of a tongue blank according to an embodiment of the disclosure.
Figure 5B:
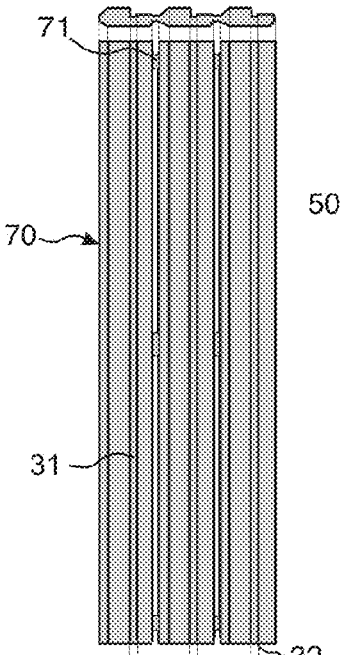
Figure 5C:
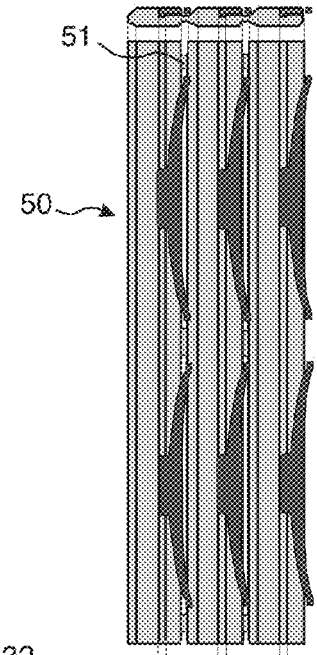
Figure 5D:
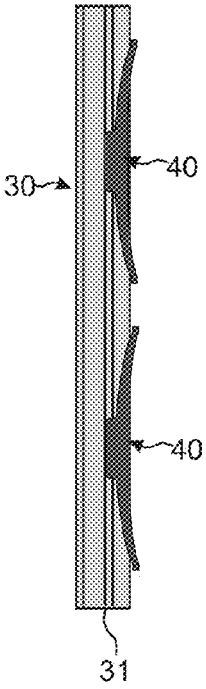
Figure 5E:
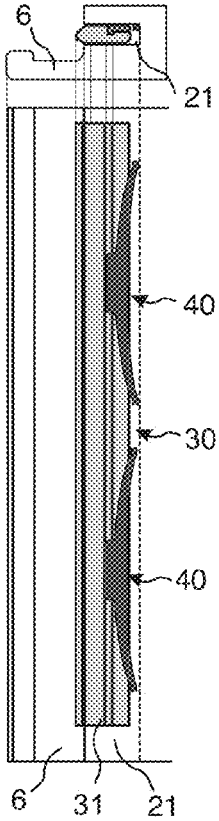
Figure 5F:
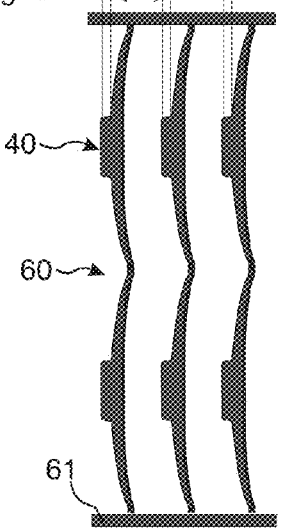
Figure 5G:
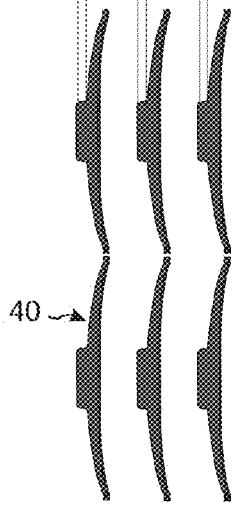

FIG. 5*a* shows a cross section of a tongue blank 50 comprising several displaceable tongues that comprise of a main tongue body 31 and separate flexible parts 40 connected to the tongue body. FIG. 5*b* shows a tongue body blank 70 comprising several tongue bodies 31 that are connected with tongue body rails 71. Such rails may, for example, be formed by punching away material from the tongue bodies. FIG. 5*f* shows a spring part blank 60 where the spring parts are positioned with essentially the same distance D between each other as the distance between the tongue bodies 31. This facilitates the fixing of the spring parts to the tongue bodies since the spring parts may be displaced after separation, shown in FIG. 5*g*, mainly parallel with the tongue bodies over the tongue bodies and pressed vertically such that the fixing connection part 42 enters the fixing groove 32. A tongue blank 50 may be formed as shown in FIG. 5*c*. Such forming may be made as a separate operation and tongue blanks are delivered as integrated blanks. The connection may also be made in line with the inserting of the tongue into the displacement groove. The tongues 30 are separated from the blank as shown in FIG. 5*d* and inserted into the displacement groove 21 as shown in FIG. 5*e*. The tongues may be inserted in a groove of the strip panel comprising the strip or into a groove formed in the other adjacent panel.

Figure 6A:
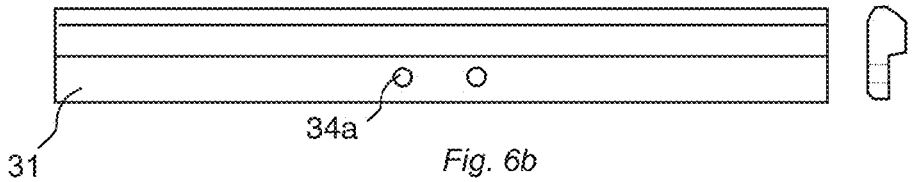
FIGS. 6*a-e* illustrate preferred embodiments of displaceable tongues.
Figure 6B:
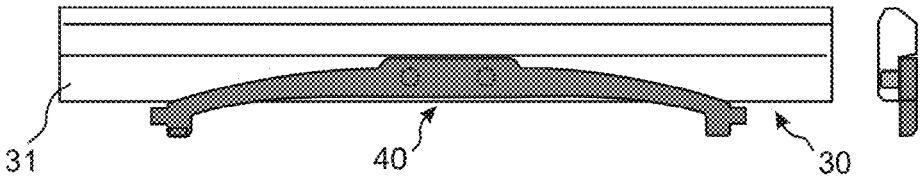
Figure 6C:
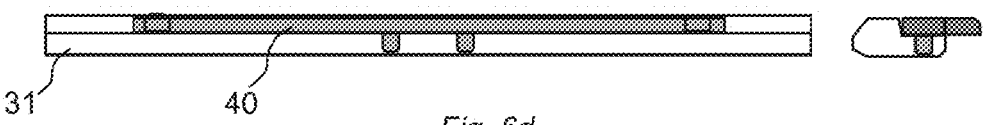
Figure 6D:
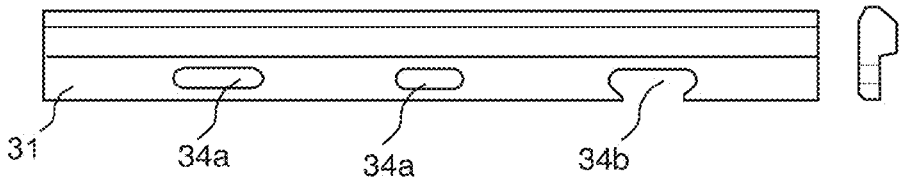
Figure 6E:
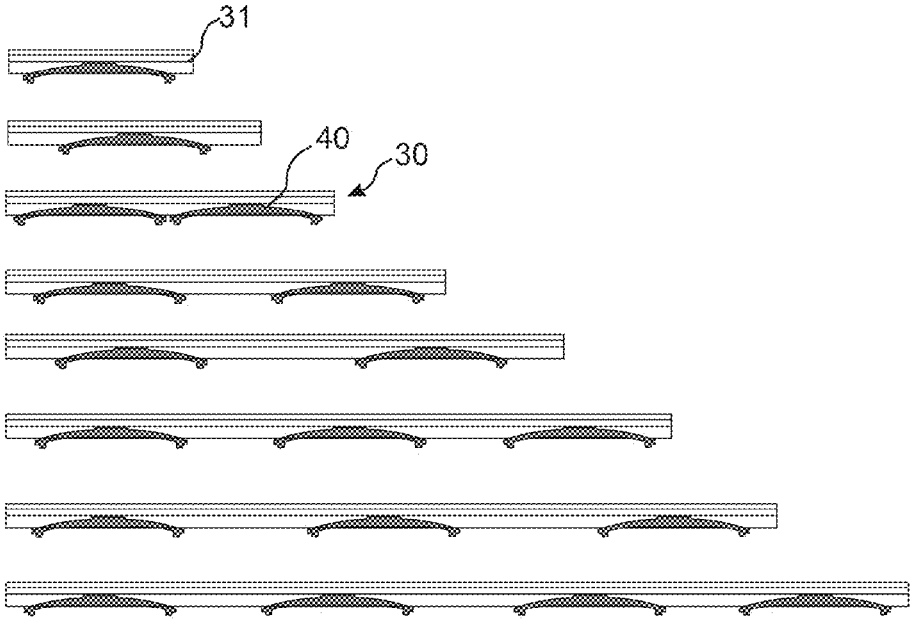

FIG. 6*a*-6*d* shows alternative methods to connect the spring parts 40 to a main tongue body 31. One or several holes 34*a* or cavities 34*b* may be formed. FIG. 6*e* shows that different lengths of the displaceable tongues may be formed by combining several spring parts that are positioned along the main tongue body 31.

Figure 7A:
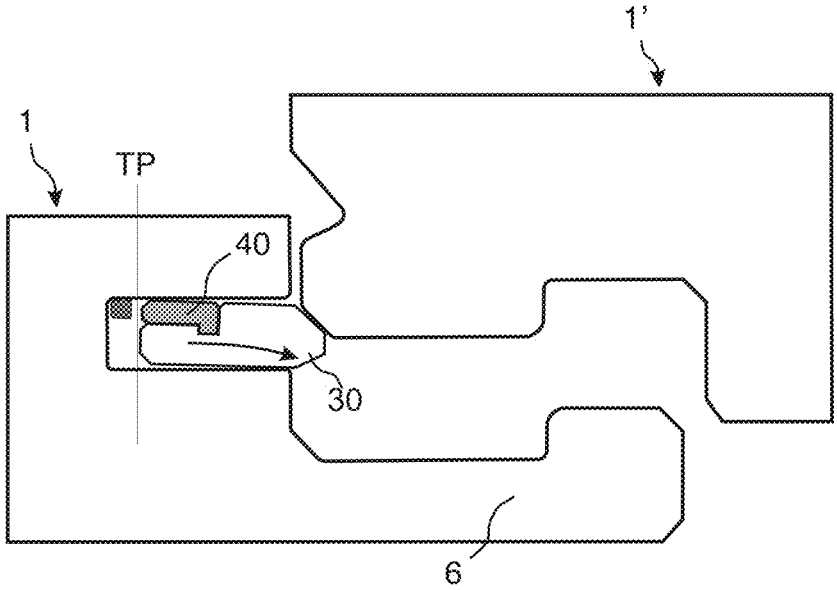
FIGS. 7*a-c* illustrate vertical locking of two panels comprising a displaceable tongue according to an embodiment of the disclosure.
Figure 7B:
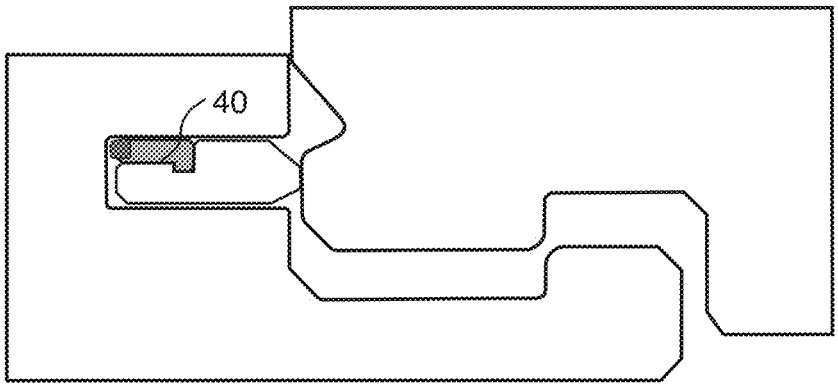
Figure 7C:
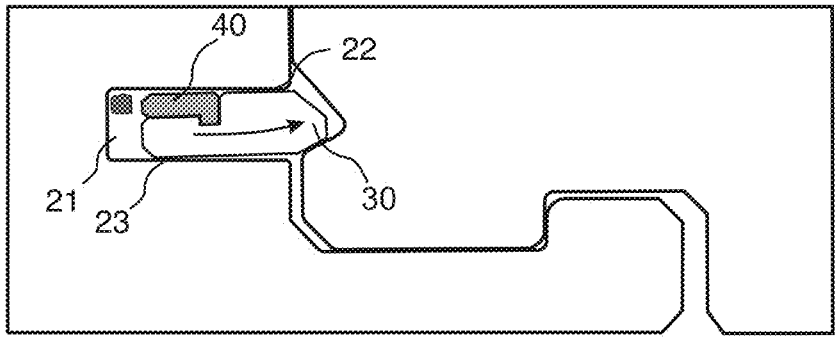
Figure 8A:
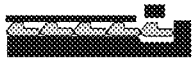
FIGS. 8*a-f* illustrate forming and fixing of a displaceable tongue according to an embodiment of the disclosure.
Figure 8B:
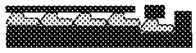
Figure 8C:
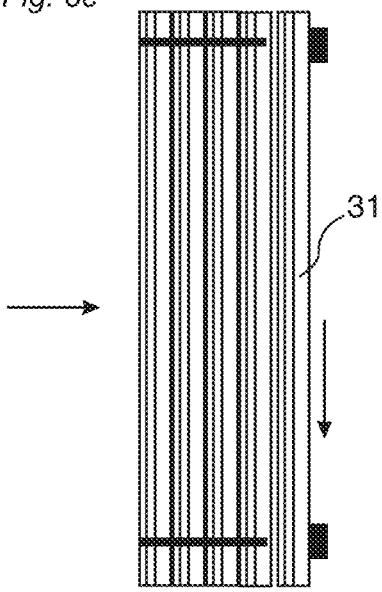
Figure 8D:
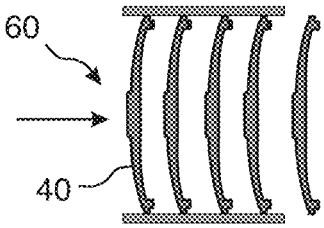
Figure 8E:
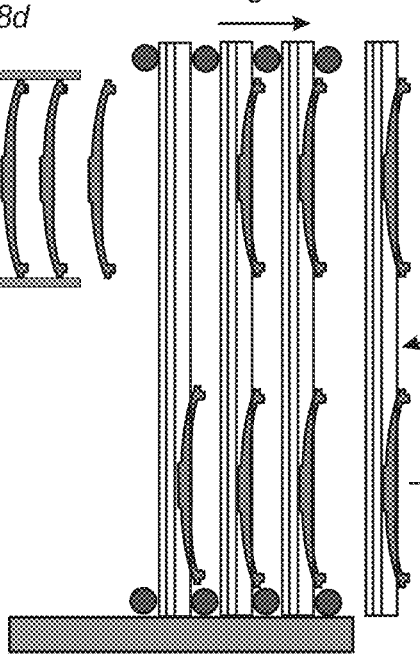
Figure 8F:
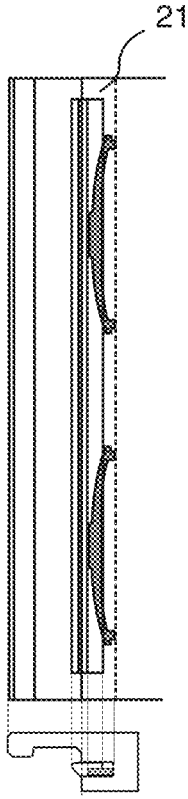

FIGS. 7*a*-7*c* show locking of two panels 1,1'. FIG. 7*a* shows that the tongue 30 tilts downwards during locking and FIG. 7*c* shows that the tongue 30 tilts upwards in locked position such that an outer part of the rigid tongue body forms an upper contact surface 22 with the displacement groove 21 and that an inner part forms a lower contact surface 23. This means that it is an advantage to connect the spring part to an upper part of the main tongue body. The spring part may of course be connected to a lower part into a fixing groove that is open downwards.

FIGS. 8*a*-8*e* shows a method to form and insert displaceable tongues into an edge of a panel that may be used, for example, when tongue bodies are delivered as loose element or as extruded sections that are cut into defined lengths. The tongue bodies 31 are displaced, for example, parallel with their lengths and spring part blanks 60 are displaced towards the tongue bodies where the spring parts 40 are separated and connected to the tongue body when the tongue body 31 is displaced in its length direction. The displaceable tongues 30 are thereafter inserted into the displacement groove 21.

Figure 9A:
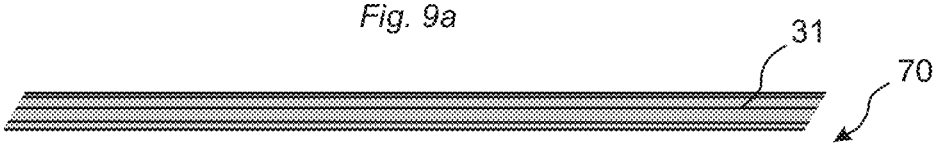
FIGS. 9*a-g* illustrate forming of a tongue blank according to an embodiment of the disclosure.
Figure 9B:
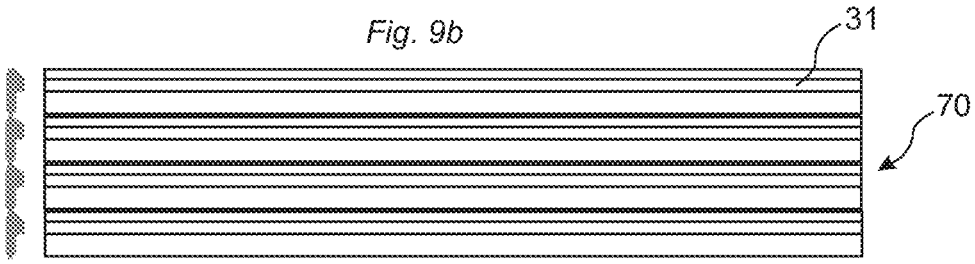
Figure 9C:
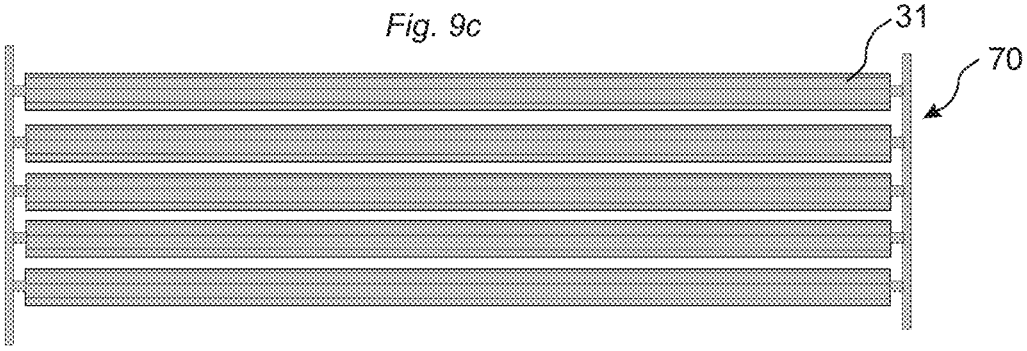

FIGS. 9*a*-9*c* show that a tongue body blank may be formed as an extruded section, FIG. 9*a,b*, or by, for example, machining a panel from a machined wood, wood/plastic or plastic panel, FIG. 9*b*, or by injection moulding, FIG. 9*c*.

Figure 9D:
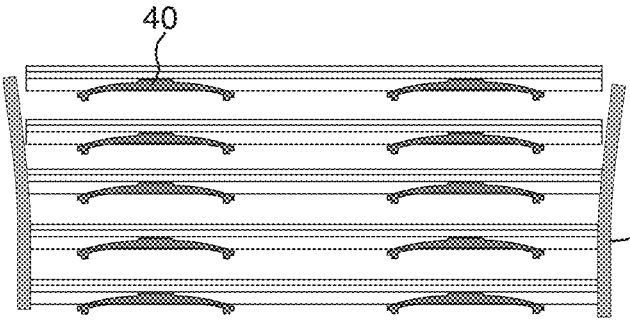
Figure 9E:
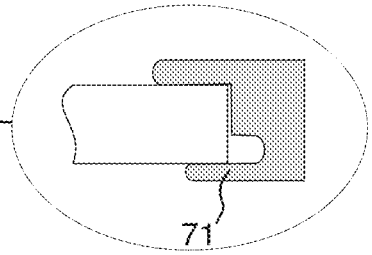
Figure 9F:
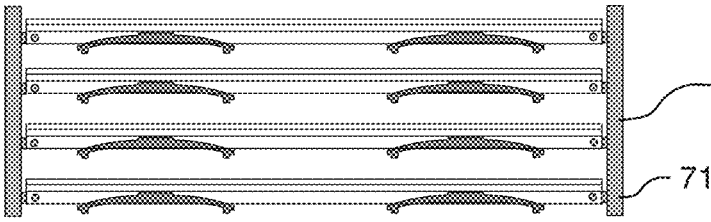
Figure 9G:
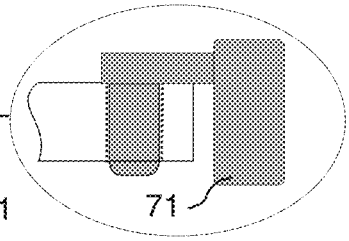

FIGS. 9*d* and 9*f* show that tongue blanks may be formed by displaceable tongues that are connected with rails that may be comprise extrudes section, FIG. 9*e*, or moulded parts, FIG. 9*g*.

Figure 10A:
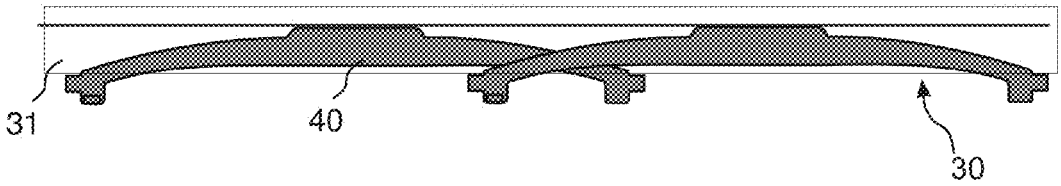
FIGS. 10*a-g* illustrate embodiments of the disclosure.
Figure 10B:
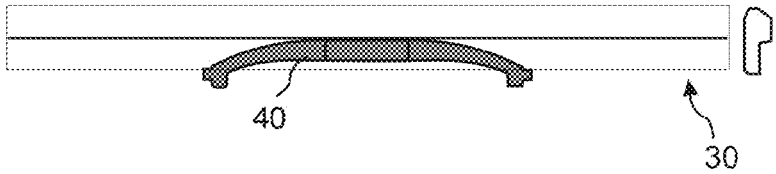
Figure 10C:
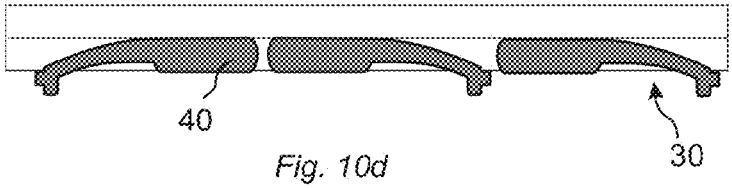
Figure 10D:
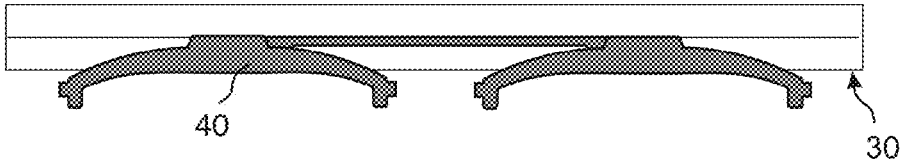

FIGS. 10*a*-10*d* show preferred embodiments of displaceable tongues 30. FIG. 10*a* shows overlapping spring parts 40. FIG. 10*b* shows a spring part that is glued to a tongue body. FIG. 10*c* show spring parts with a spring part body that is only flexible at one edge. FIG. 10*d* shows spring parts that are connected to each other.

Figure 10E:
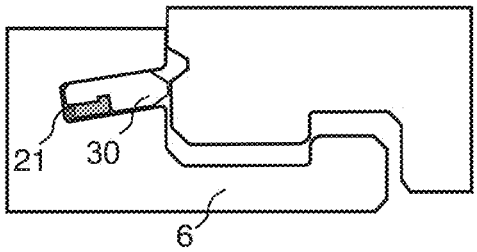
Figure 10F:
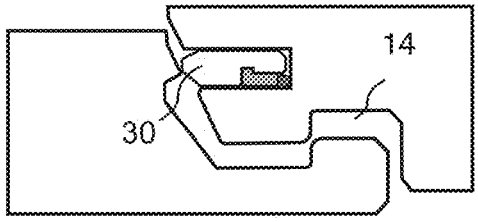
Figure 10G:
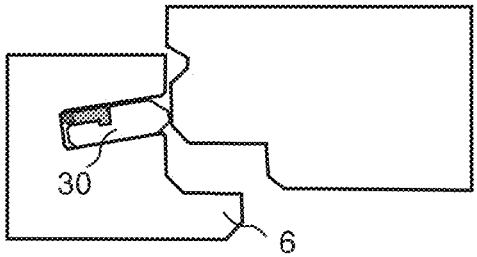

FIG. 10*e* shows a tongue 30 with a spring part that is connected into an inclined displacement groove 21 in the strip panel comprising the locking strip 6. FIG. 10*f* shows a displaceable tongue 30 inserted into an edge of a groove panel comprising the locking groove 14. FIG. 10*g* shows a locking system that only locks vertically. The strip 6 has no locking element. The horizontal locking may be accomplished with, for example, friction between the long edges.

Figure 11A:
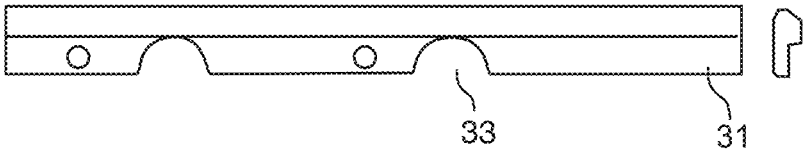
FIGS. 11*a-g* illustrate spring parts made of a compressible material according to embodiments of the disclosure.
Figure 11B:
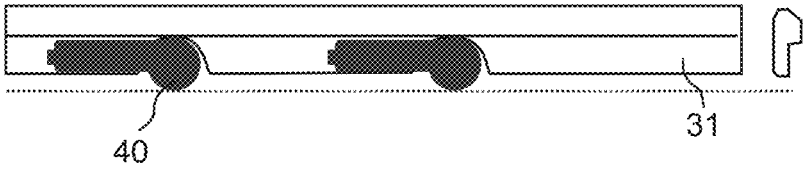
Figure 11C:
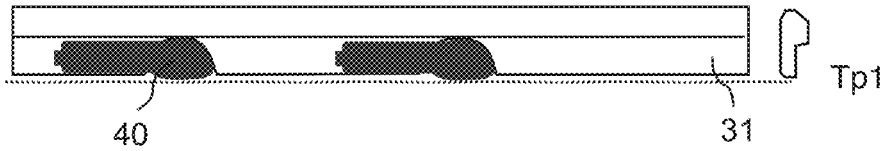
Figure 11D:
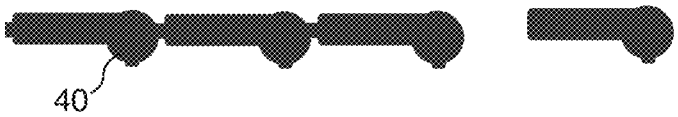
Figure 11E:
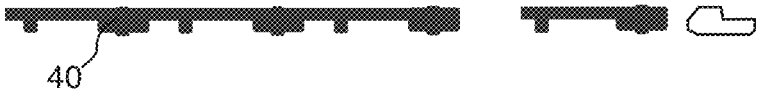
Figure 11F:
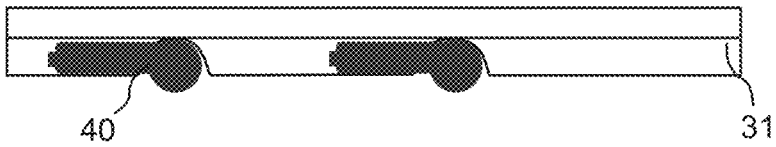
Figure 11G:
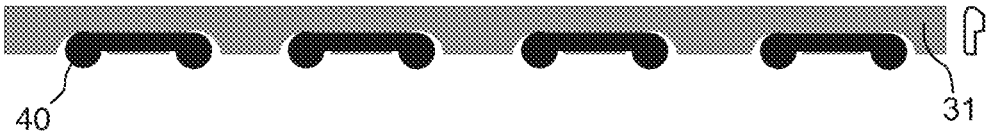
Figure 12A:
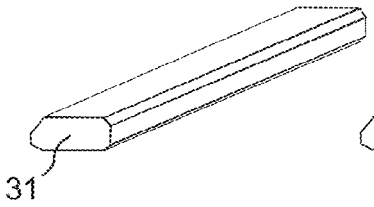
FIGS. 12*a-i* illustrate spring parts connected into cavities according to embodiments of the disclosure.
Figure 12B:
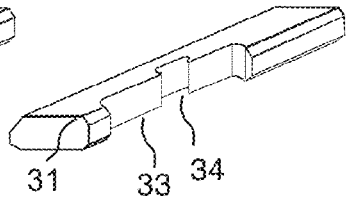
Figure 12C:
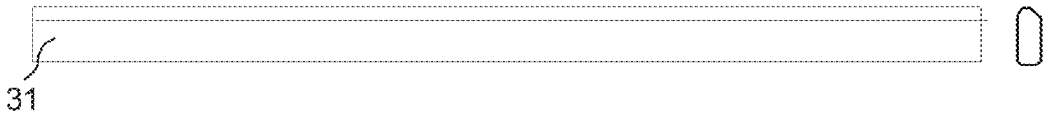
Figure 12D:
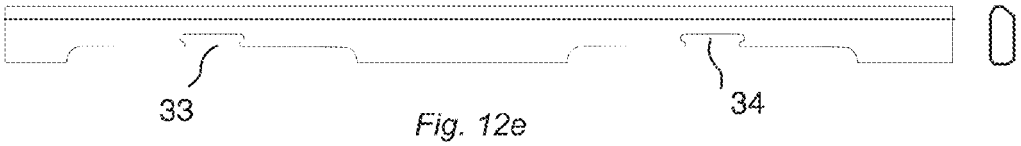
Figure 12E:
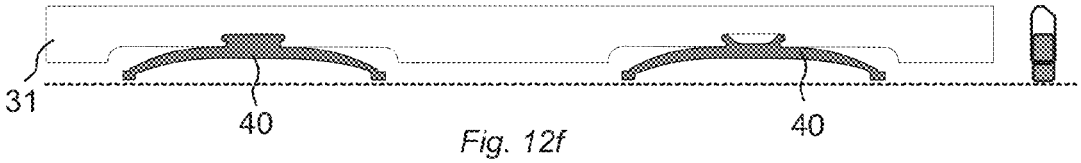
Figure 12F:
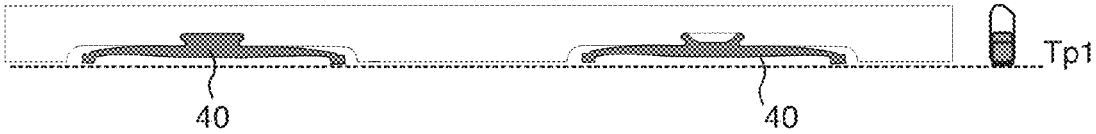
Figure 12G:
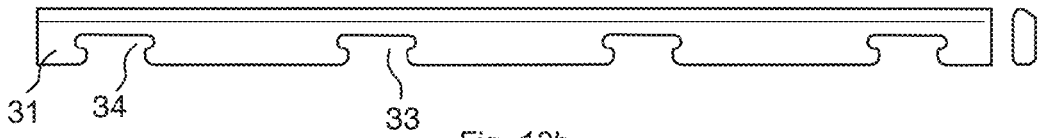
Figure 12H:
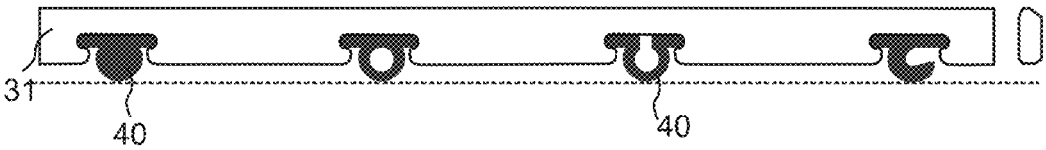
Figure 12I:
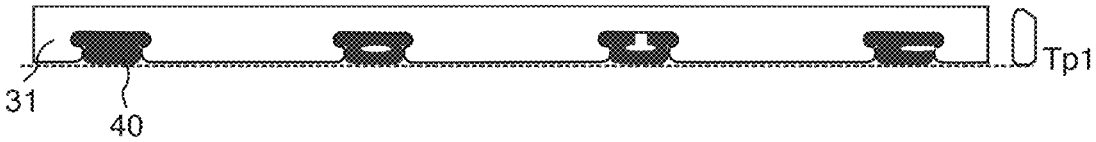

FIGS. 11*a*-11*g* shows that the spring part may also be formed from a flexible material such as, for example, rubber. The flexible parts are even in this embodiment positioned with a distance between each other along the main tongue body and the separate parts may be compressed and displaced beyond the first vertical tongue plane Tp1 as shown in FIG. 11*c*. Preferably flexing cavities 33 are formed in the main tongue body to allow such compression. The spring parts 40 are preferably asymmetric in the length direction of the displaceable tongue 30.

FIGS. 12*a*-12*i* show that several fixing cavities 33 and flexing cavities 34 may be formed in the main tongue body 31 in order to fix spring parts and to allow compression or flexing displacement within beyond the vertical tongue plane Tp1. The figures show that the tongue bodies 31 and the spring parts 40 are asymmetric in the length direction of the tongue.

Figure 13A:
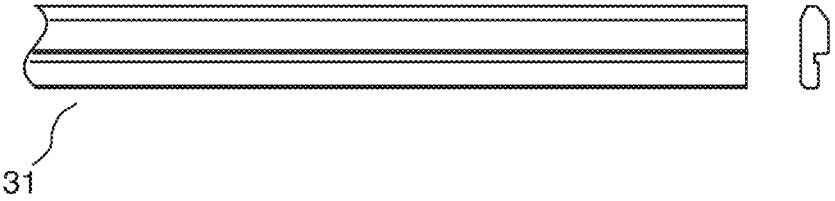
FIGS. 13*a-f* illustrate separate friction connections according to embodiments of the disclosure.
Figure 13B:
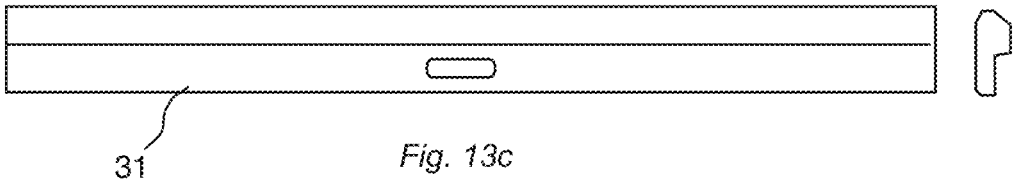
Figure 13C:
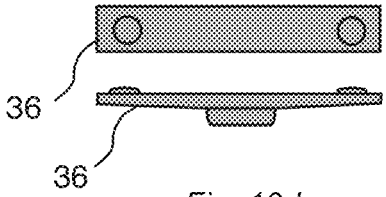
Figure 13D:
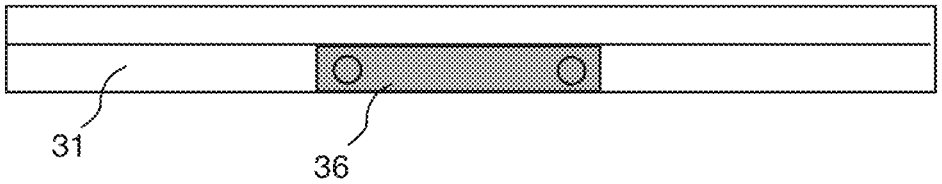
Figure 13E:
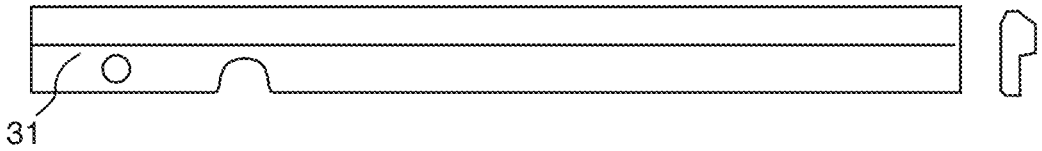
Figure 13F:
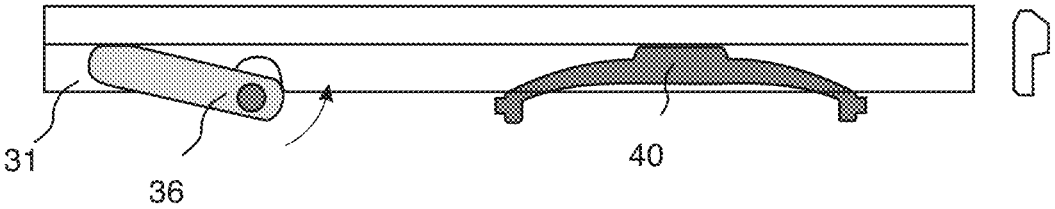
Figure 14A:
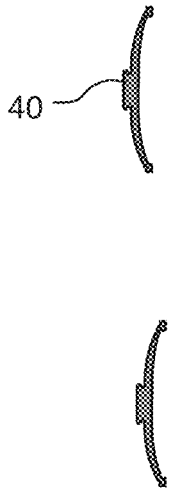
FIGS. 14*a-d* illustrate spring parts connected into a groove according to embodiments of the disclosure.
Figure 14B:
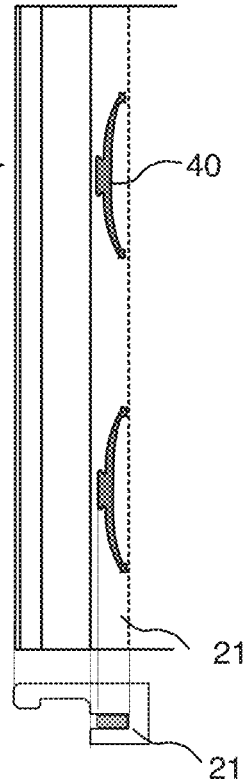
Figure 14C:
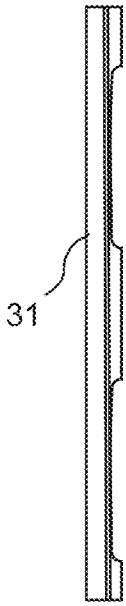
Figure 14D:
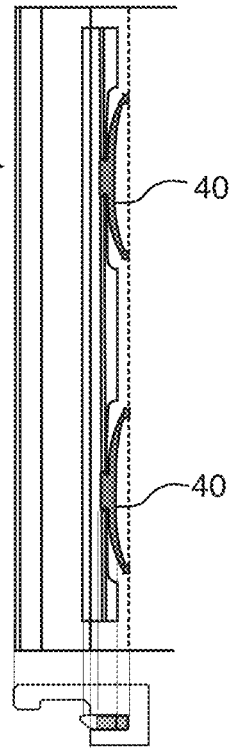

FIGS. 13*a*-13*f* show that also other parts of the displaceable tongue may be connected as separate parts, for example, friction connection 36 that may be attached to a main tongue body 31 as shown in FIG. 13*d*. FIG. 13*e* shows that a friction connection 36 may be formed and attached to the main tongue body 31 such that it may be displaced with a turning. Such turning device may be used as a link in order to displace a tongue outwardly from the displacement groove when the tongue is pushed sideways along the joint with a side pressure.

FIGS. 14*a*-14*d* show an alternative method to form a displaceable tongue that comprises separate spring parts 40. The spring parts are inserted into the displacement groove 21. A main tongue body 31 is thereafter inserted into the displacement groove and connected to the spring parts 40.

Figure 15A:
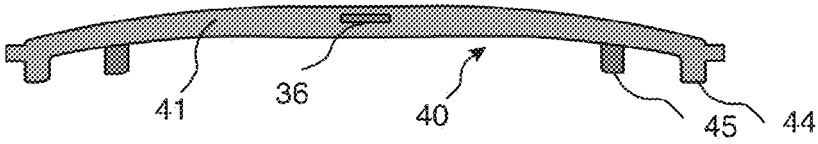
FIGS. 15*a-f* illustrate different embodiments of the disclosure.
Figure 15B:
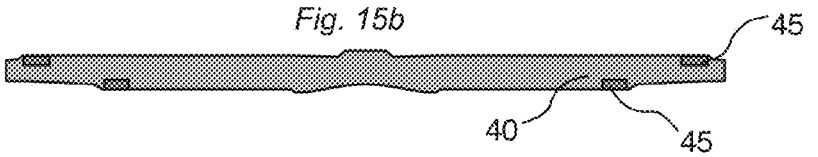
Figure 15C:
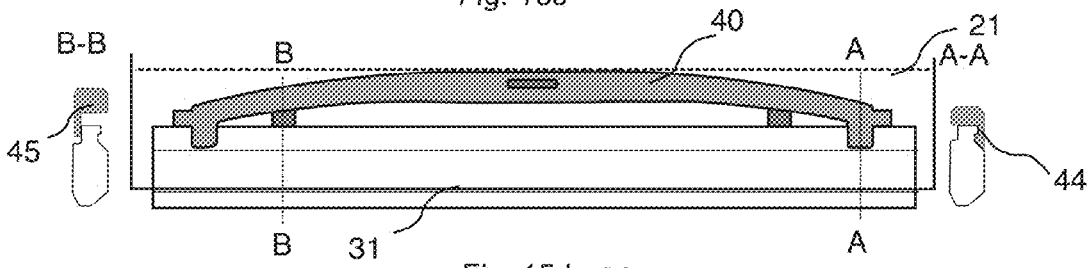
Figure 15D:
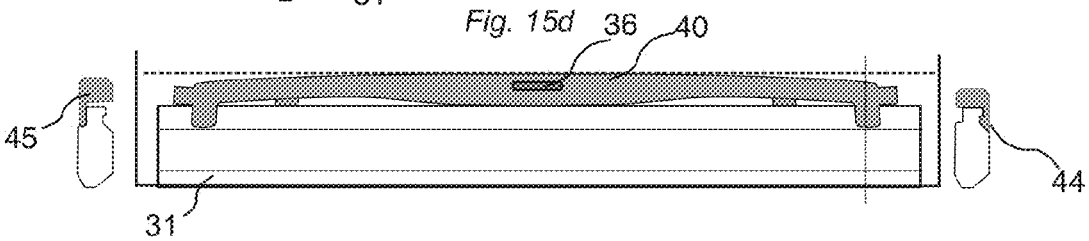
Figure 15E:
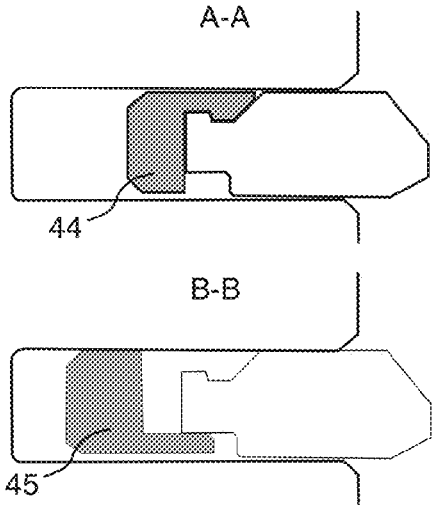
Figure 15F:
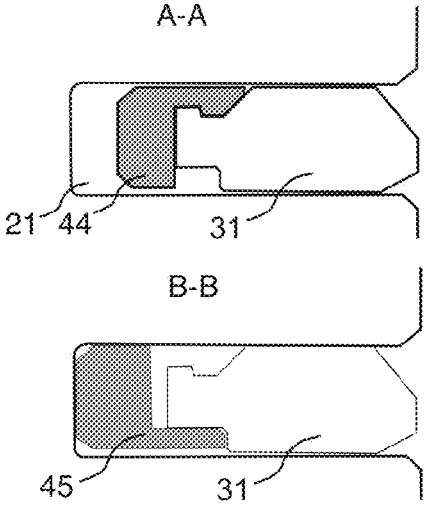

FIGS. 15*a*-15*f* shows a preferred embodiment of a spring part that is suitable to be inserted into a displacements groove 21. FIG. 15*a* shows the spring part 40 from above and FIG. 15*b* is a side view. The spring part comprises a frictions connection 36, a snapping connection 44 and a holding connection 45 located vertically at opposite upsides of the spring part. The snapping and holding connections are displaced along the spring part body 41. The main tongue body 31 is automatically snapped to the spring part that is connected with the friction connection to the displacement groove. FIGS. 15*e* and 15*f* shows cross sections during locking. The snapping connection 44 is fixed to the main tongue body and the holding connections slides against the tongue body 31 during locking. The spring part 41 may of course also be attached to the main tongue body prior to the fixing into the displacement groove 21.

Figure 16A:
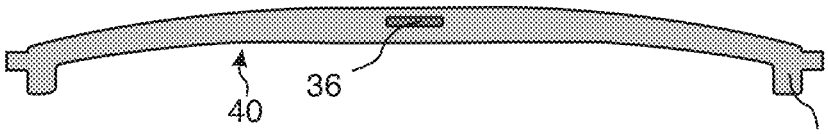
FIGS. 16*a-g* illustrate spring parts connected into a groove according to embodiments of the disclosure.
Figure 16B:
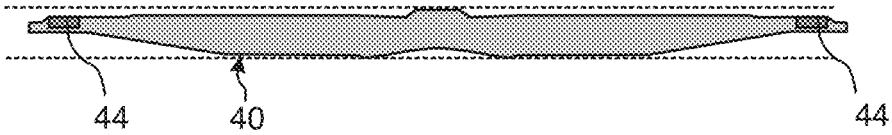
Figure 16C:
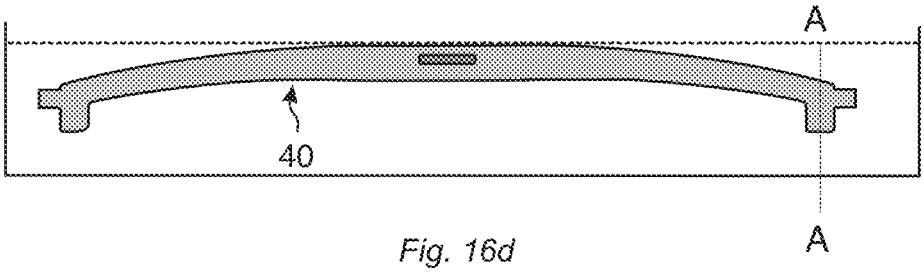
Figure 16D:
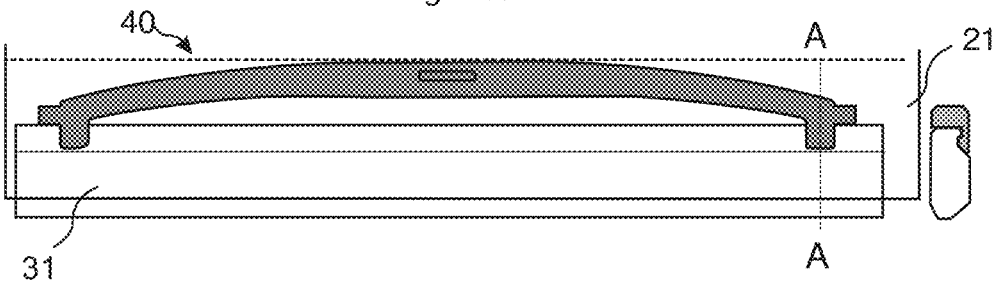
Figure 16E:
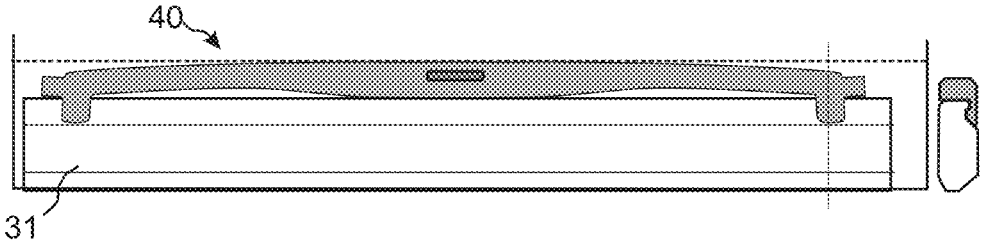
Figure 16F:
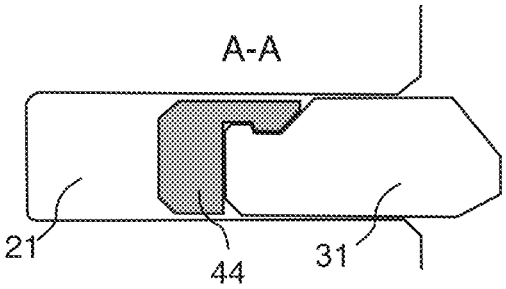
Figure 16G:
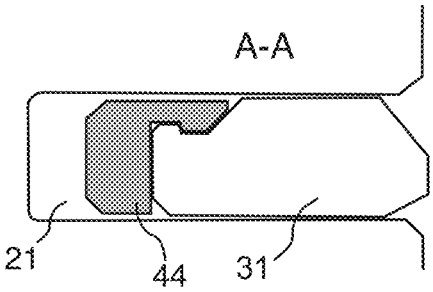
Figure 17A:
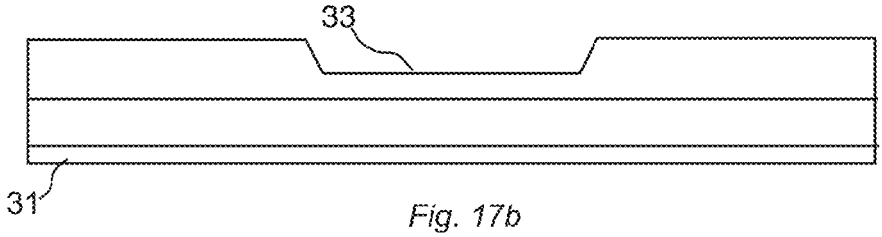
FIGS. 17*a-g* illustrate different embodiments of the disclosure.
Figure 17B:
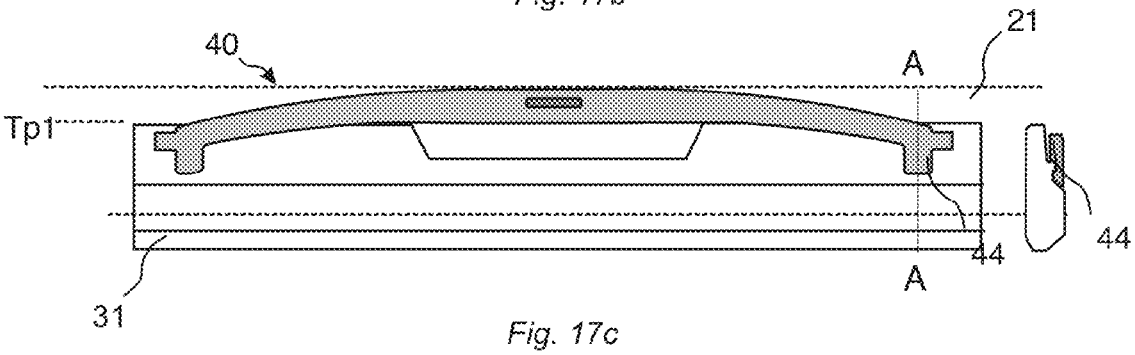
Figure 17C:
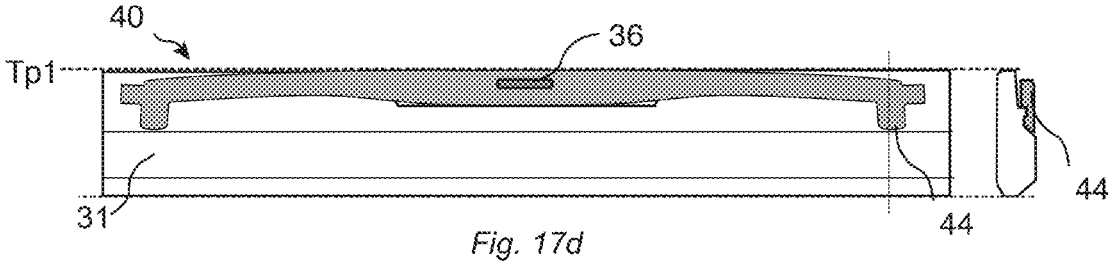
Figure 17D:
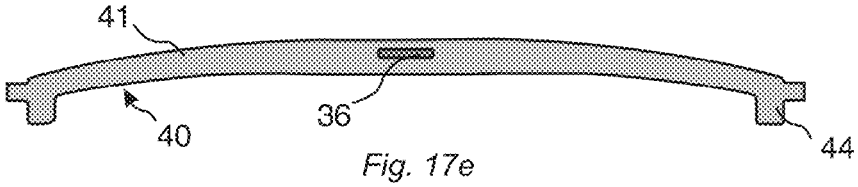
Figure 17E:
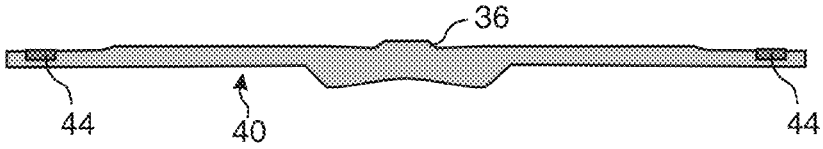
Figure 17F:
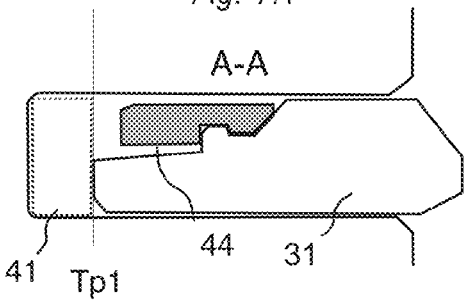
Figure 17G:
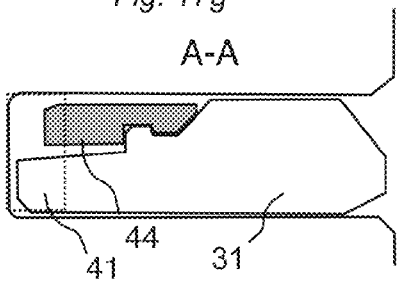

FIGS. 16*a*-*g* shows a spring part 40 that is only possible to snap to a main tongue body 31 when the spring part is already in the displacement groove 21 since the spring part only comprises a snapping connection 44 and no holding connection. FIG. 16*a* shows the spring part seen from above and FIG. 16*b* shows a side view. It is preferred that the snapping connection 44 is located on the upper part of the spring part 40.

FIGS. 17*a*-*g* shows that a flexing cavity 33 may be formed in the main tongue body 31 and this embodiment allows that a major part of the spring part body 41 may be displaced beyond the vertical tongue plane Tp1

FIG. 18*a*-18*e* shows that tongue body 31 may be formed as a three-dimensional moulded component and optimized to be snapped to a spring part. The material savings are mainly obtained due to the fact that the plastic material of the tongue body 31 may be less costly since no flexibility is required.

Figure 18A:
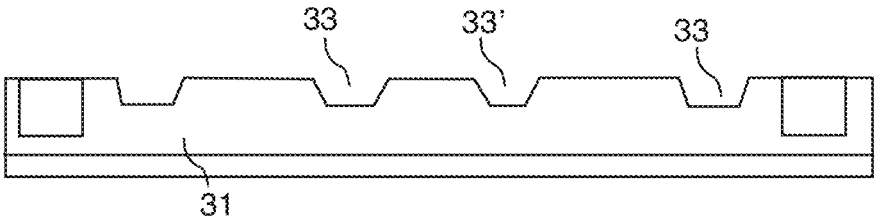
FIGS. 18*a-e* illustrate different embodiments of the disclosure.
Figure 18B:
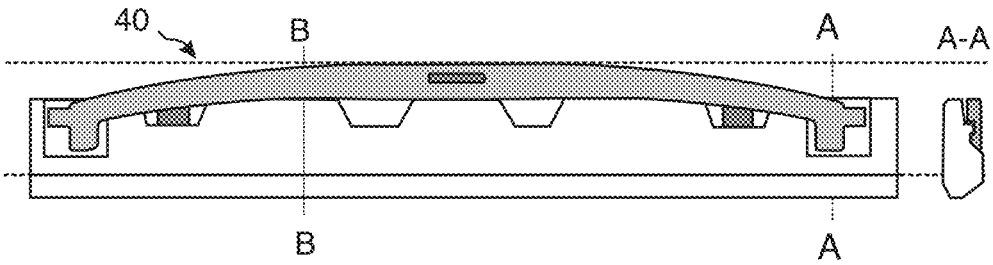
Figure 18C:
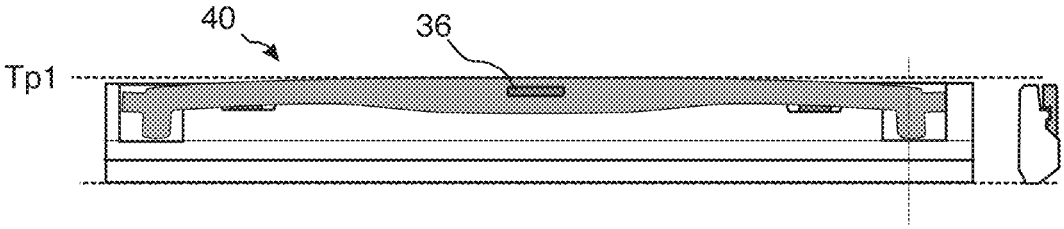
Figure 18D:
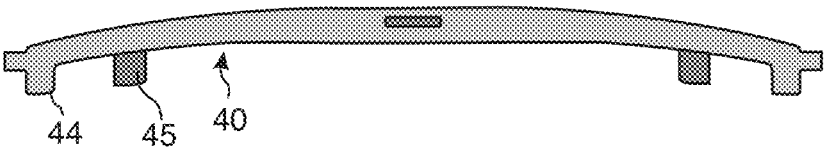
Figure 18E:
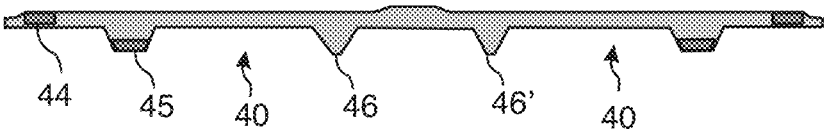

FIG. 18*e* is a side view of FIG. 18*d*. The spring part protrusions 46, 46', are during locking displaced in the displacement cavities 33, 33'.

The described tongues are mainly intended to be used on short edges of panels comprising locking systems on long edges that may be locked by angling. However, the tongues may be used on short and/or long edges.

The principles of the disclosure may also be used to form two-piece tongues that are not flexible and that are, for example, used to be displaced along the joint during locking. Separate parts may be used as, for example, wedges that during displacement create a movement of the tongue perpendicular to the edge.

The invention claimed is:

1. Building panels including at least a first building panel and a second building panel that are provided with a locking system for vertical locking of the first building panel and the second building panel by a vertical displacement of the first and second building panels relative each other, the locking system comprising a displaceable tongue attached into a sidewardly open displacement groove provided at an edge of the first building panel, said displaceable tongue cooperates with a tongue groove provided at an adjacent edge of the second building panel for locking the edge and the adjacent edge vertically, and the locking system further comprising a strip that protrudes from the edge or the adjacent edge:

below the displacement groove and outwardly beyond an upper part of the edge; or below the tongue groove and outwardly beyond an upper part of the adjacent edge, wherein the displaceable tongue comprises a main tongue body extending along the edge of the first building panel and separate flexible spring parts that are detachably attached to the main tongue body, and the separate spring parts are located in an inner part of the displacement groove and spaced from each other in an length direction of the main tongue body.

2. The building panels as claimed in claim 1, wherein the spring parts are asymmetric in a direction along the edge.

3. The building panels as claimed in claim 1, wherein the separate flexible spring parts are mechanically attached to the main tongue body.

4. The building panels as claimed in claim 1, wherein said main tongue body comprises an upwardly open fixing groove or a downwardly open fixing groove.

5. The building panels as claimed in claim 1, wherein said separate spring parts comprise an upwardly extending fixing connection part or a downwardly extending fixing connection part.

6. The building panels as claimed in claim 1, wherein said spring parts during locking are displaced or compressed horizontally beyond a vertical tongue plane that comprises an inner part of the main tongue body before locking of the first and second building panels.

7. The building panels as claimed in claim 1, wherein said spring parts overlap a part of the tongue body during locking.

8. The building panels as claimed in claim 1, wherein said spring parts are located in a vertically open flexing cavity formed in the main tongue body.

9. The building panels as claimed in claim 1, wherein said building panels are floor panels.

10. The building panels as claimed in claim 1, wherein each of the separate flexible spring parts is detachably attached to the main tongue body via a friction protrusion that presses against an inner wall of the main tongue body.

11. A tongue blank comprising at least two tongues, which are each designed to be inserted into a groove of a building panel and lock the building panel to an adjacent building panel, a part of each tongue is configured to be displaced during locking wherein the tongues are of an elongated shape and wherein each tongue comprises a separate spring part that is configured to be detachably attached to a main body of the tongue.

12. The tongue blank as claimed in claim 11, wherein the spring part is asymmetric in the length direction of the tongue.

13. The tongue blank as claimed in claim 11, wherein each tongue comprises two or more spring parts that are spaced from each other in a length direction of the tongue.

14. Building panels including at least a first building panel and a second building panel that are provided with a locking system for vertical locking of the first building panel and the second building panel by a vertical displacement of the first and second building panels relative each other, the locking system comprising a displaceable tongue attached into a sidewardly open displacement groove provided at an edge of the first building panel, said displaceable tongue cooperates with a tongue groove provided at an adjacent edge of the second building panel for locking the edge and the adjacent edge vertically, and the locking system further comprising a strip that protrudes from the edge or the adjacent edge:

below the displacement groove and outwardly beyond an upper part of the edge; or below the tongue groove and outwardly beyond an upper part of the adjacent edge, wherein the displaceable tongue comprises a main tongue body extending along the edge of the first building panel and separate flexible spring parts attached to the main tongue body, the separate spring parts are located in an inner part of the displacement groove and spaced from each other in an length direction of the main tongue body, and the main tongue body and the spring parts are made of different materials.

15. Building panels including at least a first building panel and a second building panel that are provided with a locking system for vertical locking of the first building panel and the second building panel by a vertical displacement of the first and second building panels relative each other, the locking system comprising a displaceable tongue attached into a sidewardly open displacement groove provided at an edge of the first building panel, said displaceable tongue cooperates with a tongue groove provided at an adjacent edge of the second building panel for locking the edge and the adjacent edge vertically, and the locking system further comprising a strip that protrudes from the edge or the adjacent edge:

below the displacement groove and outwardly beyond an upper part of the edge; or below the tongue groove and outwardly beyond an upper part of the adjacent edge, wherein the displaceable tongue comprises a main tongue body extending along the edge of the first building panel and separate flexible spring parts that are adapted to be attached to the main tongue body, and the separate spring parts are located in an inner part of the displacement groove and spaced from each other in an length direction of the main tongue body.

* * * * *